US009354575B2

(12) United States Patent
Nakamura

(10) Patent No.: US 9,354,575 B2
(45) Date of Patent: May 31, 2016

(54) IMAGE FORMING SYSTEM AND METHOD FOR CONTROLLING IMAGE FORMING OPERATION

(71) Applicant: KONICA MINOLTA, INC., Tokyo (JP)

(72) Inventor: Shoichi Nakamura, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/630,928

(22) Filed: Feb. 25, 2015

(65) Prior Publication Data

US 2015/0248095 A1 Sep. 3, 2015

(30) Foreign Application Priority Data

Feb. 28, 2014 (JP) ..... 2014-038971

(51) Int. Cl.
*G03G 15/00* (2006.01)

(52) U.S. Cl.
CPC ..... *G03G 15/55* (2013.01); *G03G 15/5079* (2013.01); *G03G 2215/00569* (2013.01)

(58) Field of Classification Search
None
See application file for complete search history.

(56) References Cited

U.S. PATENT DOCUMENTS

2011/0116118 A1* 5/2011 Nakase ..... 358/1.13

FOREIGN PATENT DOCUMENTS

| | | | | |
|---|---|---|---|---|
| JP | 2004-109318 | | 4/2004 | |
| JP | 2006-081010 | | 3/2006 | |
| JP | 2007-137012 A | * | 6/2007 | ..... G03G 15/01 |
| JP | 2007-137012 A | | 6/2007 | |
| JP | 2013-205682 | | 10/2013 | |

OTHER PUBLICATIONS

Notice of Reasons for Rejection issued in corresponding Japanese Patent Application No. 2014-038971, dated Feb. 23, 2016. (8 pages).

* cited by examiner

*Primary Examiner* — Clayton E Laballe
*Assistant Examiner* — Jas Sanghera
(74) *Attorney, Agent, or Firm* — Buchanan Ingersoll & Rooney PC

(57) ABSTRACT

Disclosed is a tandem-method image forming system that makes it possible to share operations for forming images onto different areas of the recording paper sheet between the image forming apparatuses included therein. Each of the image forming apparatuses includes an image forming section that forms an image onto a paper sheet; and a control section that is provided with a function for adjusting a process condition to be employed when forming the image onto the paper sheet corresponding to a target density currently established, and another function for outputting a test chart under the process condition above-adjusted.
Corresponding to the target density, each of the plurality of image forming apparatuses, which are operated in conjunction with each other through the network, revises the process condition for a plural number of times within an adjustable range, and outputs the test chart at every time when the process condition is revised.

14 Claims, 10 Drawing Sheets

IMAGE FORMING SYSTEM AND METHOD FOR CONTROLLING IMAGE FORMING OPERATION

This application is based on Japanese Patent Application NO. 2014-038971 filed on Mar. 28, 2014, with the Japan Patent Office, the entire content of which is hereby incorporated by reference.

BACKGROUND OF THE INVENTION

1. Field of the Invention

The present invention relates an image forming system in which a plurality of image forming apparatuses is cascaded serially, and a method for controlling image forming operations to be performed in the image forming system in which the plurality of image forming apparatuses is cascaded serially.

2. Description of Related Art

A tandem-method image forming system is configured by serially cascading a plurality of image forming apparatuses. Hereinafter in this specification, a term of "tandem method" is simply defined as such a connection mode in which a plurality of image forming apparatuses is coupled to each other in a serial connection mode. In the tandem-method image forming system above-mentioned, it is possible for one of the plurality of image forming apparatuses to continuously output a recording paper sheet, on a partial area of which an image is already formed thereby, to a next one of the plurality of image forming apparatuses. Then, the next one of the plurality of image forming apparatuses, included in the tandem-method image forming system concerned, may form another image onto another partial area of the recording paper sheet inputted therein.

According to the image forming system above-mentioned, it becomes possible to implement a high-speed printing operation by employing two image forming apparatuses for respectively printing images onto obverse and reverse sides of the recording paper sheet. Further, it also becomes possible to output the recording paper sheet, having high definition images, in a high-speed printing mode by employing two image forming apparatuses for respectively printing different color images onto the recording paper sheet.

Further, in a tandem-method image forming system constituted by two image forming apparatuses, by making one of the two image forming apparatuses form character images in a character image area, while making another one of the two image forming apparatuses form a pictorial image in a pictorial image area, it is possible to output the recording paper sheet, having high definition images, in a high-speed printing mode. In other words, by employing two image forming apparatuses for constituting the tandem-method image forming system, it becomes possible to improve the productivity thereof.

On the other hand, in an image forming apparatus employing the electro-photographic method, a toner image is formed on a recording paper sheet through consecutive processes including a charging process, an exposing process, a developing process, a transferring process, a fixing process and so on. Further, in order to maintain such the processes at appropriate conditions, a target value of toner adhesion amount corresponding to the maximum density level (hereinafter, referred to as a maximum-density target toner adhesion amount) is established for implementing the maximum density adjustment. Concretely speaking, according to the instructions issued by the control section, the charging voltage (electric potential of the photoreceptor member) and the developing bias voltage are adjusted so as to achieve the maximum-density target toner adhesion amount concerned.

In the above-mentioned case, even though the same value of the maximum-density target toner adhesion amount is established for each of the image forming apparatuses included in the tandem-method image forming system, and the same values of the charging voltage and the developing voltage are also established for each of the image forming apparatuses included in the tandem-method image forming system, the same maximum density level is not necessary achieved among the image forming apparatuses concerned, due to the individual differences therebetween.

In this connection, Japanese Patent Application Laid-Open Publication 2007-137012 sets forth a technology for adjusting the toner adhesion amount to be adhered onto the recording paper sheet by the image forming apparatus.

Japanese Patent Application Laid-Open Publication 2007-137012, above-cited, proposes a method for outputting a plurality of inspection-use charts printed onto the same side of the same paper sheet by changing conditions. In this connection, according to Japanese Patent Application Laid-Open Publication 2007-137012, above-cited, the plurality of inspection-use charts is printed over a single side of the paper sheet while changing gamma characteristics to be employed for image processing, without changing the process conditions.

However, with respect to the maximum density adjustment, it is necessary to halt the operation of the image forming apparatus and implement the adjusting operation by changing the process conditions, such as electric potentials of various sections, etc., instead of gamma characteristics to be used for the image processing. In other words, it is impossible to change the process conditions, such as a charging voltage, a developing voltage, etc., in midcourse of implementing a printing operation onto a single paper sheet. Owing to the above-mentioned fact, it is necessary to output an inspection-use chart onto another paper sheet every time when changing an adjusting value.

Accordingly, in the tandem-method image forming system, it is necessary to individually implement the maximum-density adjusting operation for every one of the image forming apparatuses included therein, and then, it is necessary to compare the inspection-use charts, outputted by the image forming apparatuses concerned, with each other, so as to make the maximum density levels coincide with each other. It has been apparently cumbersome and ineffective to implement the above-mentioned adjusting operations. However, no method for effectively implementing the maximum-density adjusting operation in the tandem-method image forming system as above-defined, has been proposed so far.

Further, in the tandem-method image forming system as above-mentioned, with respect to a density level other than the maximum density level, for instance, a certain intermediate density level (hereinafter, also referred to as a halftone density level), a cumbersome adjusting operation being same as the maximum density adjusting operation above-mentioned may become necessary. Namely, even for the halftone density level, no method for effectively implementing a halftone density adjusting operation in the tandem-method image forming system as above-defined, has been proposed so far.

SUMMARY OF THE INVENTION

To overcome the abovementioned drawbacks in conventional tandem-method image forming systems, it is one of objects of the present invention to provide an image forming system and a method for controlling image forming operation, each of which makes it possible to effectively adjust densities of images, which are to be formed by image forming apparatuses included in a tandem-method image forming system. Incidentally, hereinafter in the present specification, the word of "coincide" should be interpreted broadly. Accordingly, the meaning of "coincide" may include meaning of "substantially coincide" or meaning of "visibly coincide" and so on.

Accordingly, at least one of the objects of the present invention can be attained by any one of the image forming systems and the method for controlling image forming operation, described as follows.

(1) According to an image forming system reflecting an aspect of the present invention, the image forming system comprises: a plurality of image forming apparatuses that forms images onto a recording paper sheet; and a network through which the plurality of image forming apparatuses is serially cascaded so as to make it possible to share operations for forming the images onto different areas of the recording paper sheet between the plurality of image forming apparatuses; wherein each of the plurality of image forming apparatuses comprises: an image forming section that forms an image onto a paper sheet; and a control section that is provided with a process condition adjusting function for adjusting a process condition to be employed at a time when forming the image onto the paper sheet corresponding to a target density currently established, and a test-chart outputting function for outputting a test chart under the process condition above-adjusted; and wherein, corresponding to the target density, each of the plurality of image forming apparatuses, which are operated in conjunction with each other through the network, revises the process condition for a plural number of times within an adjustable range, and outputs the test chart at every time when the process condition is revised.

(2) According to another aspect of the present invention, in the image forming system recited in item 1, when the process condition is adjusted so as to make densities of images, which are to be respectively formed by the plurality of image forming apparatuses, coincide with each other therebetween, it is desirable that each of the plurality of image forming apparatuses, which are operated in conjunction with each other through the network, revises the process condition for the plural number of times, and outputs the test chart.

(3) According to still another aspect of the present invention, in the image forming system recited in item 1 or 2, it is desirable that the process condition is adjusted in order to establish a maximum density. (4) According to still another aspect of the present invention, in the image forming system recited in any one of items 1-3, it is desirable that the process condition is adjusted in order to establish a halftone density.

(5) According to still another aspect of the present invention, in the image forming system recited in any one of items 1-4, it is desirable that the test chart includes first information representing an adjusting value, which is employed at the time when the process condition is revised within the adjustable range and second information indicating one of the plurality of image forming apparatuses, from which the test chart is printed out.

(6) According to still another aspect of the present invention, in the image forming system recited in any one of items 1-5, it is desirable that each of the plurality of image forming apparatuses stores third information representing the process condition before revised, therein; and, after operations for revising the process condition within the adjustable range and outputting the test chart have been completed, it is desirable that each of the plurality of image forming apparatuses resumes the process condition before revised.

(7) According to still another aspect of the present invention, in the image forming system recited in any one of items 1-5, it is desirable that each of the plurality of image forming apparatuses is provided with a function for accepting an adjusting value, which is to be employed at the time when the process condition is revised; and, after operations for revising the process condition within the adjustable range and outputting the test chart have been completed, it is desirable that each of the plurality of image forming apparatuses adjusts the process condition based on the adjusting value above-accepted.

According to a method for controlling an image forming operation reflecting yet another aspect of the present invention, the method for controlling an image forming operation, which is to be implemented in an image forming system that comprises a plurality of image forming apparatuses that forms images onto a recording paper sheet, and a network through which the plurality of image forming apparatuses is serially cascaded so as to make it possible to share operations for forming the images onto different areas of the recording paper sheet between the plurality of image forming apparatuses, wherein each of the plurality of image forming apparatuses is constituted by an image forming section that forms an image onto a paper sheet; and a control section that is provided with a process condition adjusting function for adjusting a process condition to be employed at a time when forming the image onto the paper sheet corresponding to a target density currently established, and a test-chart outputting function for outputting a test chart under the process condition above-adjusted, the method comprises the steps of: operating the plurality of image forming apparatuses in conjunction with each other through the network; making each of the plurality of image forming apparatuses revise the process condition for a plural number of times within an adjustable range; and outputting the test chart at every time when the process condition is revised.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
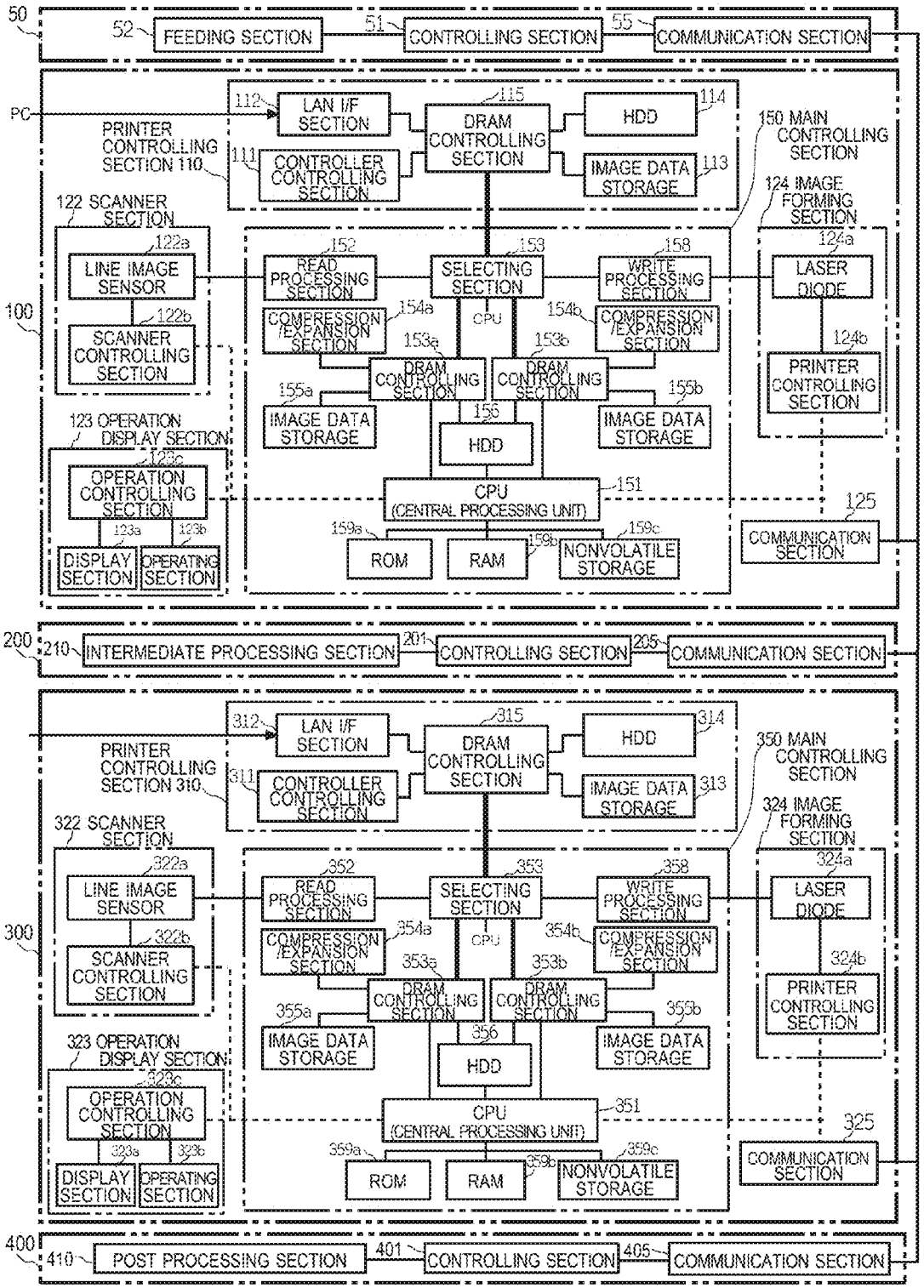
FIG. 1 is a block diagram showing a configuration of an image forming system in accordance with an embodiment of the present invention.

Referring to the drawings, a tandem-method image forming system in accordance with an embodiment of the present invention will be detailed in the following.

<Overall Configuration of Tandem-Method Image Forming System>

Figure 2:
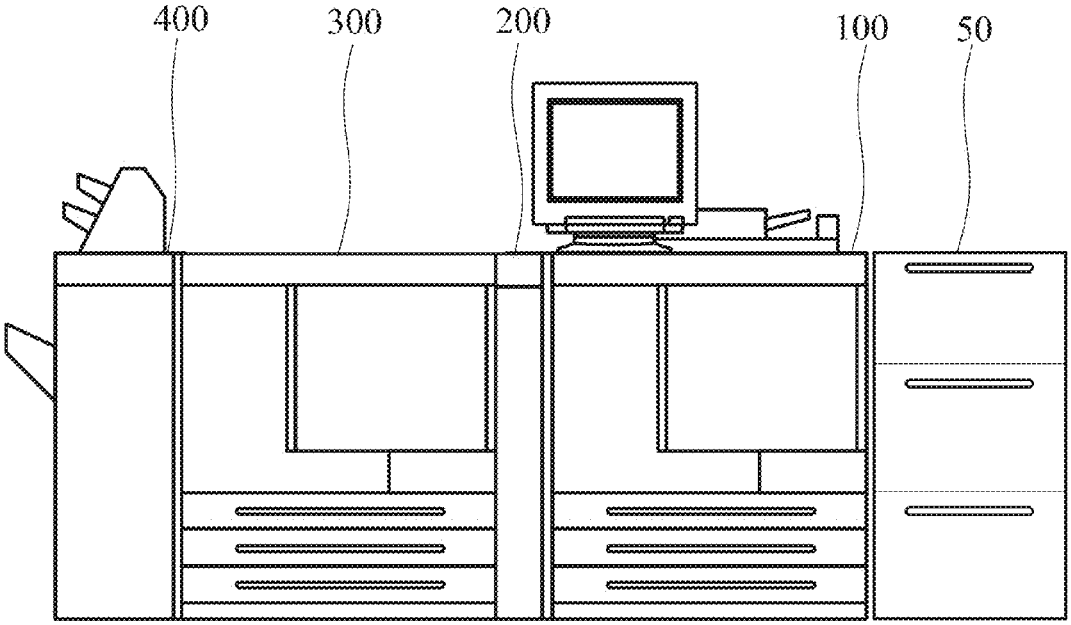
FIG. 2 is a schematic diagram showing a configuration of an image forming system in accordance with an embodiment of the present invention.
Figure 3:
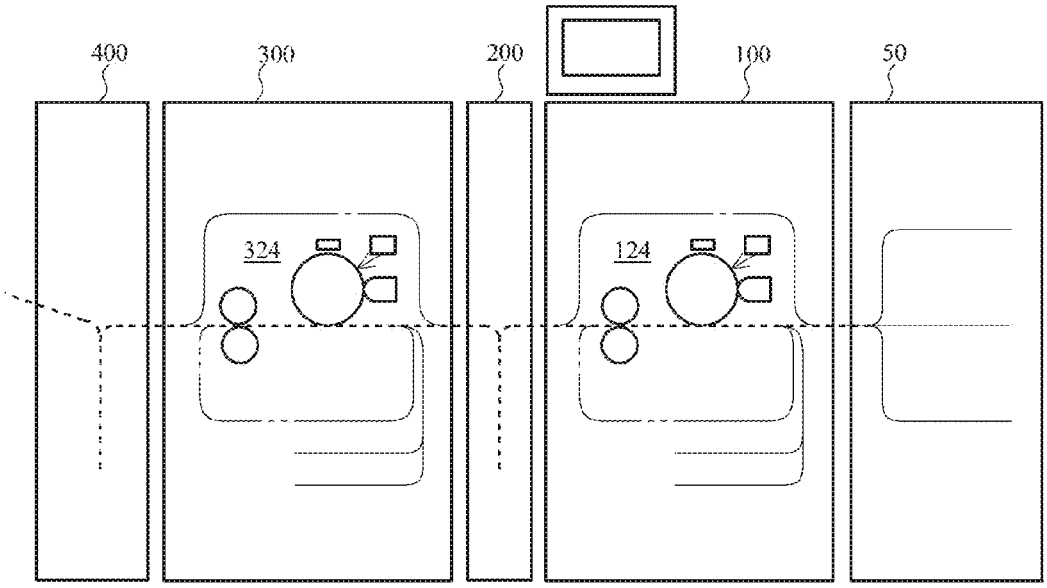
FIG. 3 is another schematic diagram showing a configuration of an image forming system in accordance with an embodiment of the present invention.

Referring to FIG. 1 through FIG. 3, the tandem-method image forming system in which a first image forming apparatus 100 and a second image forming apparatus 300 are serially cascaded in such a manner that the first image forming apparatus 100 and the second image forming apparatus 300 can share image forming operations to be implemented onto obverse and reverse sides of a recording paper sheet or recording areas within a single page area with each other, will be detailed in the following.

In this connection, hereinafter, the tandem-method image forming system, in which the first image forming apparatus 100 and the second image forming apparatus 300 are serially cascaded, and in which a paper sheet feeding apparatus 50, an intermediate processing apparatus 200 and a post processing apparatus 400 are included, is exemplified as a concrete example of the embodiment of the present invention. In this connection, the scope of the present invention is not limited to the first image forming apparatus 100 and the second image forming apparatus 300 above-mentioned. It is also applicable that three or more number of image forming apparatuses are serially cascaded in the tandem-method image forming system.

Further, although each of the first image forming apparatus 100 and the second image forming apparatus 300 can be independently operated, in this embodiment, both of them are serially cascaded so as to constitute the image forming system.

In the tandem-method image forming system shown in FIG. 2 and FIG. 3, the paper sheet feeding apparatus 50, the first image forming apparatus 100, the intermediate processing apparatus 200, the second image forming apparatus 300 and the post processing apparatus 400 are serially cascaded in this order, along the flowing direction of the recording paper sheet that flows from the right to the left on each of the schematic diagrams shown in FIG. 2 and FIG. 3.

In the tandem-method image forming system above-mentioned, the paper sheet feeding apparatus 50 feeds a recording paper sheet onto which an image is to be formed. The first image forming apparatus 100 performs an image forming operation onto the shared one of obverse and reverse sides of the recording paper sheet, or onto any one of divided recording areas within a single page area. The intermediate processing apparatus 200 applies an intermediate processing, such as a reverse processing, etc., to the recording paper sheet on which an image is already formed by the first image forming apparatus 100, and then, supplies the recording paper sheet to the second image forming apparatus 300 serving as a post image forming stage.

Successively, receiving the recording paper sheet fed from the intermediate processing apparatus 200, the second image forming apparatus 300 performs another image forming operation onto the other shared one of the obverse and reverse sides of the recording paper sheet, or onto another shared one of the divided recording areas within the single page area. Then, the post processing apparatus 400 applies various kinds of post processing, such as a punch processing, a staple processing, a bind processing, etc., to the recording paper sheet on which the images have been formed by both the first image forming apparatus 100 and the second image forming apparatus 300.

In this connection, hereinafter in the present embodiment, the phrase of "serially cascaded" represents such a state that plural image forming apparatuses are serially coupled to each other along a flowing direction of a paper sheet. Accordingly, various kinds of apparatuses other than the image forming apparatus, such as an intermediate processing apparatus, etc., may be installed into various positions located between the plural image forming apparatuses.

In this connection, in the schematic diagram shown in FIG. 3, the path indicated by the broken lines is a paper sheet passing path, while the other path indicated by the alternate long and short dash lines is a bypassing path, in the tandem-method image forming system. Further, still the other path indicated by the alternate long and two short dashes lines is a duplex printing path to be employed at the time when the image forming apparatus concerned is independently operated.

According to the image forming system as above-mentioned, since the intermediate processing apparatus 200, disposed between the first image forming apparatus 100 and the second image forming apparatus 300, reverses the recording paper sheet, it becomes possible to make the first image forming apparatus 100 and the second image forming apparatus 300 respectively form images onto obverse and reverse sides of the recording paper sheet only by making the recording paper sheet pass through the paper sheet passing path indicated by the broken lines shown in FIG. 3. As a result, it becomes possible to advantageously implement a high speed outputting operation of the printed products.

In this connection, other than the above-mentioned sharing mode in which the image forming operations to be performed onto the obverse and reverse sides of the recording paper sheet are shared between the image forming apparatuses included in the tandem-method image forming system, a different sharing mode may be possible. For instance, it is possible for the first image forming apparatus 100 and the second image forming apparatus 300 to share image forming operations on separate areas, such as upper and lower portions or right and left portions within the same page area of the recording paper sheet, or the like.

Further, it is also possible for the first image forming apparatus 100 and the second image forming apparatus 300 to share image forming operations in regard to different colors, such as a normal color or a special color within the same page area of the recording paper sheet, or the like. Still further, it is also possible for the first image forming apparatus 100 and the second image forming apparatus 300 to share image forming operations in regard to images having different gradations, such as characters (unicolor without gradation) and a pictorial image (gradation image), or the like.

Referring to the schematic diagrams shown in FIG. 1 and FIG. 2, the various configurations of the apparatuses, included in the tandem-method image forming system, will be sequentially detailed in the following one by one. In this connection, hereinafter, the first image forming apparatus 100 serves as a main apparatus in the tandem-method image forming system and has the initiative thereof. On the other hand, hereinafter, such a case that the second image forming apparatus 300 serves as a sub apparatus and has a role for depending on the first image forming apparatus 100 in the image forming system concerned will be exemplified as a concrete example. However, the relationship between the main apparatus and the sub-system may be vice versa.

Further, the main role and the sub role are respectively allotted to the first image forming apparatus 100 and the second image forming apparatus 300 by connecting them with each other. In other words, the tandem-method image forming system is configured fundamentally by combining the same kinds of standalone-type image forming apparatuses with each other.

Still further, the paper sheet feeding apparatus 50, the first image forming apparatus 100, the intermediate processing apparatus 200, the second image forming apparatus 300 and the post processing apparatus 400 are provided with communication sections 55, 125, 205, 325, 405 and control sections 51, 150, 201, 350, 401, respectively, so that the control sections 51, 150, 201, 350, 401 can communicate with each other through the communication sections 55, 125, 205, 325, 405. As a result of the above-mentioned communicating operations, linked controlling operations can be achieved.

<Configuration of Image Forming Apparatus>

FIG. 1 shows a block diagram indicating a configuration of the first image forming apparatus 100 constituting a main section of the image forming system in accordance with the first embodiment of the present invention. The first image forming apparatus 100 is constituted by a printer controlling section 110, a scanner section 122, an operation display section 123, an image forming section 124, the communication section 125 and a main controlling section 150, which serve as roughly divided sections.

The printer controlling section 110 is coupled to an information processing apparatus, such as a personal computer, etc., through a network such as a LAN (Local Area Network), etc. Further, the printer controlling section 110 implements a RIP (Raster Image Processor) processing to apply a rasterize processing to the print job sent from the information processing apparatus so as to generate image data. In this connection, the image data above-generated is bitmap image data usable for the image forming operation.

The print job received from the information processing apparatus by the printer controlling section 110 includes such print data that represents characters and figures written in code data and vector data, for instance, print data written in the Page Description Language. Further, the RIP processing is defined as such a processing for developing the print data constituted by code data and vector data into the bitmap image data.

The printer controlling section 110 is provided with a controller controlling section 111, a LAN (Local Area Network) interface section 112, an image data storage 113, an HDD (Hard Disc Drive) 114 and a DRAM (Dynamic Random Access Memory) controlling section 115.

In this connection, the controller controlling section 111 includes a CPU (Central Processing Unit) so as to totally control the operations to be performed by the printer controlling section 110 concerned. The LAN interface section 112 implements operations for communicating with external apparatuses through the network. The image data storage 113 stores the image data generated by applying the RIP processing, etc., therein. The HDD 114 stores and accumulates various kinds of print data received from the external apparatuses through the network, various kinds of intermediate data generated during the process of the RIP processing, etc., therein. The DRAM controlling section 115 controls not only operations for reading/writing data from/to the image data storage 113, but also operations for receiving/transmitting various kinds of data from/to the image forming section 124.

Other than the above, a ROM (Read Only Memory) into which various kinds of programs and data to be read and executed by the controller controlling section 111 are stored, a working memory into which various kinds of data are temporarily stored at the time when the controller controlling section 111 is executing a program, etc., are coupled to the controller controlling section 111, though those are not shown in the drawings.

The scanner section 122 optically reads a document in the color or monochrome reading mode so as to acquire image data representing an image residing on the document. For this purpose, the scanner section 122 is constituted by a scanner controlling section 122*b* that controls the overall operation of the scanner section 122 concerned, in addition to a line image sensor 122*a*.

The operation display section 123 is capable of displaying various kinds of setting screens and operating screens thereon and displays various kinds of guide information, notifications, warning messages, etc., for the user, thereon. Further, the operation display section 123 accepts various kinds of setting items, selecting operations, editing operations, an outputting instruction (instruction for commencing an image forming operation), which are inputted by the user.

In this connection, the operation display section 123 is constituted by a display section 123*a*, an operating section 123*b* and an operation controlling section 123*c*. The display section 123*a* is provided with a LCD (Liquid Crystal Display), etc. The operating section 123*b* is provided with a touch panel mounted over the screen and other switches. The operation controlling section 123*c* controls the display section 123*a* and the operating section 123*b*.

The image forming section 124 is provided with an LD (Laser Diode) 124*a* and a printer controlling section 124*b*. In this connection, the LD 124*a* is modulated in accordance with the image data in the ON/OFF controlling mode. The printer controlling section 124*b* controls operations of a process unit or the like. In this connection, the image forming section 124 implements the printing operation by employing the electrophotographic method.

Concretely speaking, the image forming section 124 forms a toner image onto a paper sheet through the consecutive electro-photographing processes, including the charging process, the exposing process, the developing process, the transferring process, the fixing process, and so on. On that occasion, a target value of toner adhesion amount corresponding to the maximum density level (hereinafter, also referred to as a maximum-density target toner adhesion amount) is established for implementing the maximum density adjustment. Then, according to the instructions issued by a CPU (Central Processing Unit) 151 and/or the printer controlling section 124*b*, the charging voltage (electric potential of the photoreceptor member) and the developing bias voltage are adjusted so as to achieve the maximum-density target toner adhesion amount concerned. Incidentally, since the internal configuration of the image forming section 124 that employs the electro-photographic method is sufficiently well-known among the skilled persons in this field, the detailed explanations thereof are omitted hereinafter.

In this connection, each of the scanner controlling section 122*b*, the operation controlling section 123*c* and the printer controlling section 124*b* is constituted by a CPU (Central Processing Unit), a ROM (Read Only Memory), a RAM (Random Access Memory), etc., each of which are mounted on an electric circuit board as a main parts thereof. Then, each of the scanner controlling section 122*b*, the operation controlling section 123*c* and the printer controlling section 124*b* implements various kinds of controlling operations in accordance with the program stored in the ROM.

The main controlling section 150 in conjunction with the control sections, provided in the various sections, totally controls the overall operations to be performed in the first image forming apparatus 100. For this purpose, the main controlling section 150 is constituted by a CPU 151, a read processing section 152, a selecting section 153, a DRAM controlling section 153*a* (DRAM controlling section (1)), a DRAM controlling section 153*b* (DRAM controlling section (2)), a compression/expansion section 154*a* (compression/expansion section (1)), a compression/expansion section 154*b* (compression/expansion section (2)), an image data storage 155*a* configured by semiconductor memory devices (image data storage (1)), an image data storage 155*b* configured by semiconductor memory devices (image data storage (2)), an HDD 156, a write processing section 158, a ROM 159*a*, a RAM 159*b* and a nonvolatile storage 159*c*.

The CPU 151 totally control all of the image forming operations. The ROM 159*a* stores programs and various kinds of default data or the like, therein. The CPU 151 executes various kinds of programs stored in the ROM 159*a*. The RAM 159*b* serves as a working storage into which various kinds of data, to be used at the time when the CPU 151 executes the program, are temporarily stored. The nonvolatile storage 159*c* stores the user's data, the system data, the various kinds of setting values, etc., which should be stored even after the electric power source is turned OFF, therein.

The read processing section 152 applies an image enlarge processing, a mirror image processing, an error diffusion processing, etc. to the image data outputted by the scanner section 122, as needed. Under the instruction issued by the CPU 151, the selecting section 153 selects any one of the DRAM controlling section 153*a* and the DRAM controlling section 153*b*.

The DRAM controlling section 153*a* conducts operations for controlling the read/write and refresh timings of the image data storage 155*a* constituted by the Dynamic RAM, and also conducts various kinds of timing controlling operations at the time when compressing image data so as to store the compressed image data into the image data storage 155*a*, or when reading the compressed image data from the image data storage 155*a* to expand the compressed image data concerned.

The DRAM controlling section 153*b* conducts operations for controlling the read/write and refresh timings of the image data storage 155*b* constituted by the Dynamic RAM, and also conducts various kinds of timing controlling operations at the time when compressing image data so as to store the compressed image data into the image data storage 155*b*, or when reading the compressed image data from the image data storage 155*b* to expand the compressed image data concerned.

Further, both the DRAM controlling section 153*a* and the DRAM controlling section 153*b* are coupled to the DRAM controlling section 115 through the selecting section 153 and a PCI (Peripheral Component Interconnect) bus. Still further, both the DRAM controlling section 153*a* and the DRAM controlling section 153*b* receive/transmit various kinds of data from/to the printer controlling section 110 through the selecting section 153.

The compression/expansion section 154*a* compresses the image data by employing the image data storage 155*a* as a storage area, so as to generate the compressed image data. Further, the compression/expansion section 154*a* expands the compressed image data by employing the image data storage 155*a* as a storage area, so as to resume the original image data.

As well as the above-mentioned, the compression/expansion section 154*b* compresses the image data by employing the image data storage 155*b* as a storage area, so as to generate the compressed image data. Further, the compression/expansion section 154*b* expands the compressed image data by employing the image data storage 155*b* as a storage area, so as to resume the original image data.

The image data storage 155*a* is employed by the compression/expansion section 154*a* in order to store the compressed image data generated by applying the compression processing and/or the expanded image data, therein. While, the image data storage 155*b* is employed by the compression/expansion section 154*b* in order to store the compressed image data generated by applying the compression processing and/or the expanded image data, therein.

The HDD 156 stores data to be employed for printing (job data), which is received from the printer controlling section 110, or the like, therein. In accordance with the image data expanded after read from the image data storage 155*a* or the image data storage 155*b*, the write processing section 158 outputs signals for modulating the LD 124*a*, including laser diodes respectively corresponding to the primary colors, in the ON/OFF switching mode, at the timing corresponding to the operation performed by the image forming section 124.

In this connection, in the present embodiment, the configuration of the first image forming apparatus 100 and that of the second image forming apparatus 300 are the same as each other, and the reference numbers attached to the first image forming apparatus 100 and those to be attached to the second image forming apparatus 300 are made to correspond to each other. Accordingly, explanations for the second image forming apparatus 300, which may duplicate with the explanations made for the first image forming apparatus 100, will be omitted in the following. Incidentally, it is applicable that, although both of a printer controlling section 310 and an operation display section 323 exist in the second image forming apparatus 300 serving as the sub apparatus, both of them are in the disabled state.

Further, it is also applicable that, although the configuration of the first image forming apparatus 100 and that of the second image forming apparatus 300 are substantially the same as each other, both of the printer controlling section 310 and the operation display section 323 do not exist in the second image forming apparatus 300.

<Operations to be Performed in Image Forming System and Method for Controlling Image Forming Operation>

Next, referring to the flowcharts shown in FIG. 4, FIG. 7, FIG. 8, FIG. 11, FIG. 12, FIG. 13, image forming operations to be performed in the image forming system in accordance with an embodiment of the present invention and the method for controlling the image forming operations, will be detailed in the following.

<First Operation>

Initially, referring to the flowchart shown in FIG. 4, an operation for making the maximum density level of the first image forming apparatus 100 and that of the second image forming apparatus 300 coincide with each other, will be detailed in the following as the first operation of the present embodiment.

Figure 4:
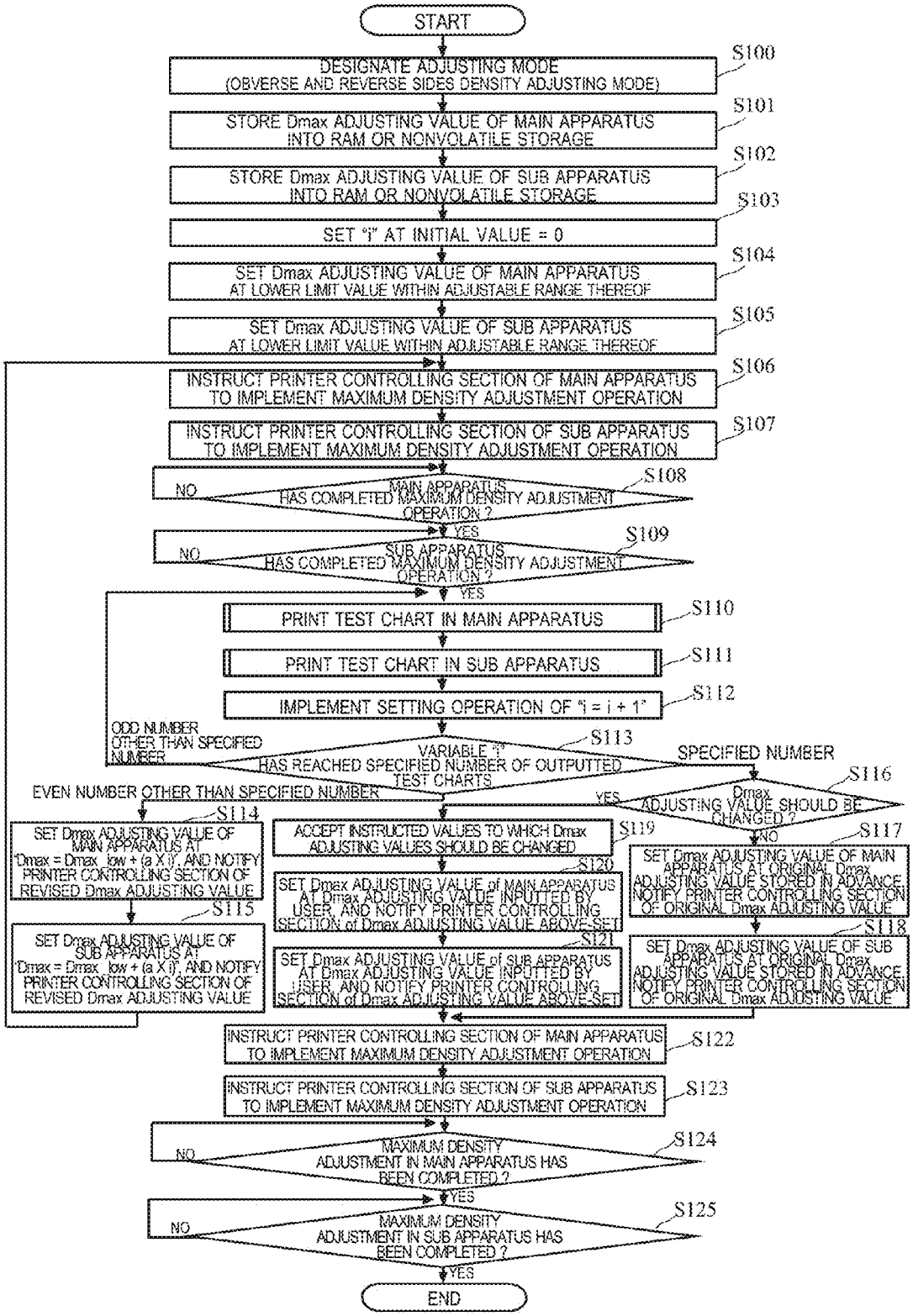
FIG. 4 is a flowchart indicating a flow of operations to be implemented in an image forming system in accordance with an embodiment of the present invention.

At first, any one of the operation display section 123 and external information apparatuses designates an adjusting mode for making the maximum density levels of the image forming apparatuses, included in the image forming system concerned, coincide with each other (Step S100, shown in FIG. 4). In the present embodiment, the first image forming apparatus 100 and the second image forming apparatus 300 are included in the image forming system. Further, the first image forming apparatus 100 and the second image forming apparatus 300 respectively share the printing operations on the obverse and reverse sides of the same paper sheet. Accordingly, a both-sides density adjusting mode is designated to the first image forming apparatus 100 and the second image forming apparatus 300.

Now, such a case that the operation display section 123 designates the both-sides density adjusting mode will be detailed in the following. The user designates the adjustment mode from a display screen 123*g*1 by depressing a button 123*g*1*a* shown in FIG. 5, and then, designates the both-sides density adjusting mode by depressing a button 123*g*1*b* shown in FIG. 5, and further, selects a both-sides maximum-density automatic adjusting mode by depressing a button 123*g*1*c* shown in FIG. 5.

Figure 6:
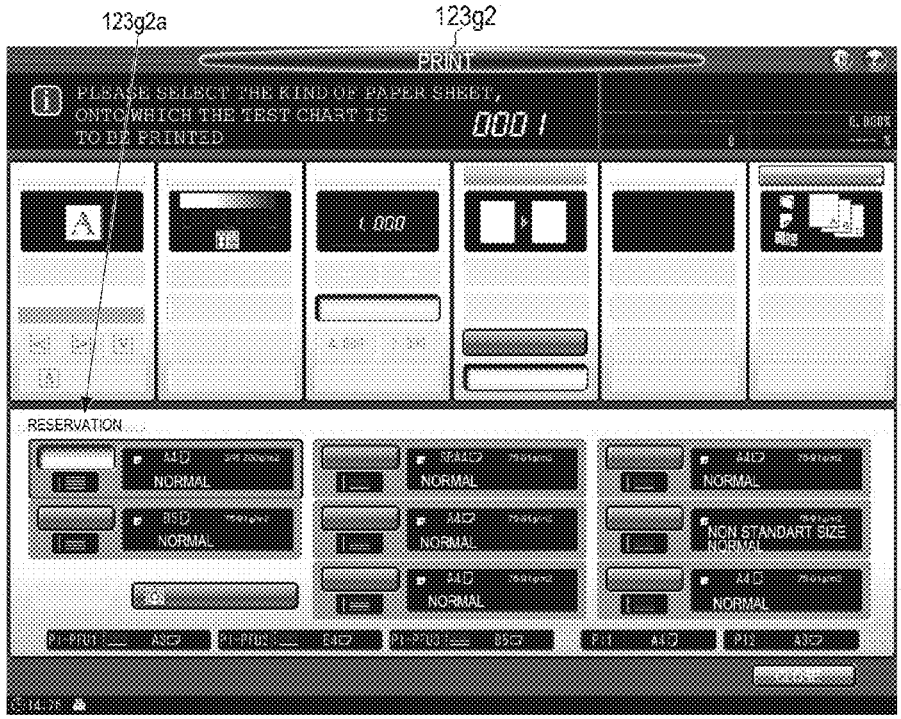
FIG. 6 is a schematic diagram showing an example of another display screen to be displayed in an image forming system in accordance with an embodiment of the present invention.

Successively, a display screen 123*g*2, shown in FIG. 6, emerges on the operation display section 123 in order to request the user to select a kind of paper sheet onto which a test chart is to be printed. Then, the user selects the kind of paper sheet, onto which the test chart is to be printed, from paper sheet reservation setting items 123*g*2*a*, shown in FIG. 6. Alternatively, the image forming system may be configured in such a manner that the CPU 151 automatically selects any one of the trays, on which a paper sheet capable of outputting the test chart resides.

Still successively, the CPU 151, provided in the main controlling section 150, cooperates with the printer controlling section 124*b*, provided in the image forming section 124, to store a currently effective value as the Dmax adjusting value into the RAM 159*b* or the nonvolatile storage 159*c* (Step S101, shown in FIG. 4). The Dmax adjusting value, above-mentioned, is employed for designating the charging voltage (electric potential of the photoreceptor member) and the developing bias voltage, for yielding the maximum density (Dmax) of the image forming section 124.

In this connection, hereinafter, the Dmax adjusting value is defined as such a value that is variable in a plurality of the predetermined steps within a range between upper and lower adjustable limits, while setting the value for yielding the standard maximum density, determined as the default value for the image forming section 124 before shipment, at 0 (zero).

As the concrete example of the present embodiment, the value for yielding the standard maximum density, determined as the default value for the image forming section 124 before shipment, is established at 0, and a Dmax_low serving as the lower limit value for yielding the lower limit maximum density is established at −5, while a Dmax_high serving as the upper limit value for yielding the upper limit maximum density is established at +3, and so on. In the above-mentioned setting condition, the Dmax adjusting value can be adjusted stepwise for nine steps one by one.

As well as the above-mentioned, the CPU 151, provided in the main controlling section 150, cooperates with the printer controlling section 324*b*, provided in the image forming section 324, to store a currently effective value as the Dmax adjusting value into the RAM 159*b* or the nonvolatile storage 159*c* (Step S102, shown in FIG. 4). The Dmax adjusting value, above-mentioned, is employed for designating the charging voltage (electric potential of the photoreceptor member) and the developing bias voltage, for yielding the maximum density (Dmax) of the image forming section 324.

In this connection, it is also applicable that, receiving the instruction from the CPU 151, the CPU 351 cooperates with the printer controlling section 324*b*, provided in the image forming section 324, to store a currently effective value as the Dmax adjusting value into the RAM 359*b* or the nonvolatile storage 359*c*.

Still successively, the CPU 151 sets variable "i", which indicates a number of test charts to be outputted, at the initial value, namely, sets as "i"=0 (Step S103, shown in FIG. 4). Then, the CPU 151 sets the Dmax adjusting value of the image forming section 124 at the Dmax_low serving as the lower limit value within the adjustable range thereof, and notifies the printer controlling section 124*b* of the above-setting (Step S104, shown in FIG. 4). Further, the CPU 151 sets the Dmax adjusting value at the Dmax_low of the image forming section 324 serving as the lower limit value within the adjustable range thereof, and notifies the printer controlling section 324*b* of the above-setting (Step S105, shown in FIG. 4).

Still successively, the CPU 151 instructs the printer controlling section 124*b* to implement the maximum density adjustment operation (Step S106, shown in FIG. 4). Receiving the instruction for implementing the maximum density adjustment operation from the CPU 151, the printer controlling section 124*b* implements the maximum density adjustment operation based on the Dmax adjusting value above-established. Concretely speaking, the printer controlling section 124*b* implements the operation for adjusting the charging voltage (electric potential of the photoreceptor member) and the developing bias voltage of the image forming section 124, so as to achieve the target value of toner adhesion amount corresponding to the Dmax adjusting value above-established.

Still successively, as well as the above-mentioned, the CPU 151 instructs the printer controlling section 324*b* to implement the maximum density adjustment operation (Step S107, shown in FIG. 4). Receiving the instruction for implementing the maximum density adjustment operation from the CPU 151, the printer controlling section 324*b* implements the maximum density adjustment operation based on the Dmax adjusting value above-established. Concretely speaking, the printer controlling section 324*b* implements the operation for adjusting the charging voltage (electric potential of the photoreceptor member) and the developing bias voltage of the image forming section 324, so as to achieve the target value of toner adhesion amount corresponding to the Dmax adjusting value above-established.

Still successively, the CPU 151 confirms whether or not the printer controlling section 124*b* has completed the maximum density adjustment operation (Step S108, shown in FIG. 4). When determining that the printer controlling section 124*b* has completed the maximum density adjustment operation, the CPU 151 makes the processing proceed to the next step (Step S108; YES, shown in FIG. 4). As well as the abovementioned, the CPU 151 confirms whether or not the printer controlling section 324*b* has completed the maximum density adjustment operation (Step S109, shown in FIG. 4). When determining that the printer controlling section 324*b* has completed the maximum density adjustment operation, the CPU 151 makes the processing proceed to the next step (Step S109; YES, shown in FIG. 4).

Still successively, the CPU 151 instructs the printer controlling section 124*b* to make the first image forming apparatus 100 print a test chart in the state that the maximum density adjustment operation has been completed (Step S110, shown in FIG. 4). As well as the above-mentioned, the CPU 151 instructs the printer controlling section 324*b* to make the second image forming apparatus 300 print a test chart in the state that the maximum density adjustment operation has been completed (Step S111, shown in FIG. 4).

Still successively, after completing the operation for printing the test chart, the CPU 151 adds "1" to variable "i", representing a number of test charts currently outputted, namely, implements the setting operation of "i=i+1" (Step S112, shown in FIG. 4). Then, the CPU 151 determines whether or not variable "i" has reached a specified number of outputted test charts (Step S113, shown in FIG. 4). In this connection, the specified number of outputted test charts is defined as a predetermined value established in advance. In this concrete example of the present embodiment, the specified number of outputted test charts is established in advance at "i=10", namely, total 10 sheets of test charts are automatically outputted.

Still successively, when determining that variable "i" is an odd number other than the specified number (Step S113; ODD NUMBER OTHER THAN SPECIFIED NUMBER, shown in FIG. 4), the CPU 151 makes the processing return to Step S110, and instructs the printer controlling section 124*b* to make the first image forming apparatus 100 print a next test chart (Step S110, shown in FIG. 4). Further, the CPU 151 also instructs the printer controlling section 324*b* to make the second image forming apparatus 300 print a test chart (Step S111, shown in FIG. 4). Then, in regard to variable "i", representing the number of test charts currently outputted, the CPU 151 implements the setting operation of "i=i+1" (Step S112, shown in FIG. 4).

Concretely speaking, after both the first image forming apparatus 100 and the second image forming apparatus 300 have completed the operations for printing the test charts in the state that variable "i" is set at the initial value of "0" (Step S110 and Step S111, shown in FIG. 4), the setting operation of "i=i+1" is implemented (Step S112, shown in FIG. 4). As a result, variable "i" changes to "1" (odd number other than the specified number) from the initial value of "0" (Step S113; ODD NUMBER OTHER THAN SPECIFIED NUMBER, shown in FIG. 4). Accordingly, both the first image forming apparatus 100 and the second image forming apparatus 300 again implement the operations for printing the test charts (Step S110 and Step S111, shown in FIG. 4).

Next, referring to the subroutine flowchart shown in FIG. 7, the operation for printing the test chart to be implemented in the first image forming apparatus 100 (corresponding to Step S110 shown in FIG. 4), will be detailed in the following, while, referring to the other subroutine flowchart shown in FIG. 8, the operation for printing the test chart to be implemented in the second image forming apparatus 300 (corresponding to Step S111 shown in FIG. 4), will be also detailed in the following. In addition, referring to the schematic diagram shown in FIG. 9, the output statuses of the test charts will be detailed in the following.

Figure 7:
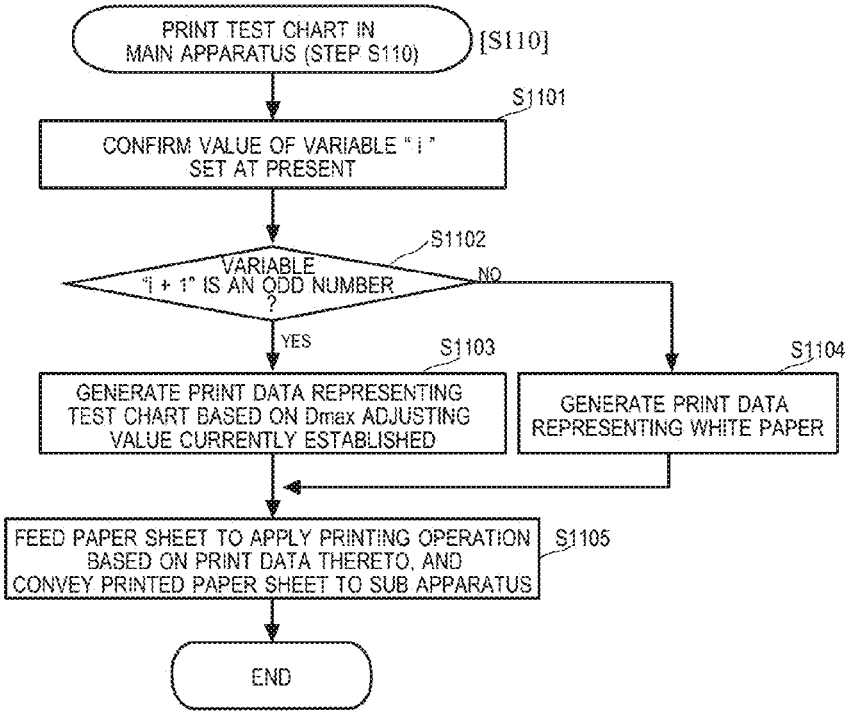
FIG. 7 is a flowchart indicating a subroutine flow of operations to be implemented in an image forming system in accordance with an embodiment of the present invention.
Figure 8:
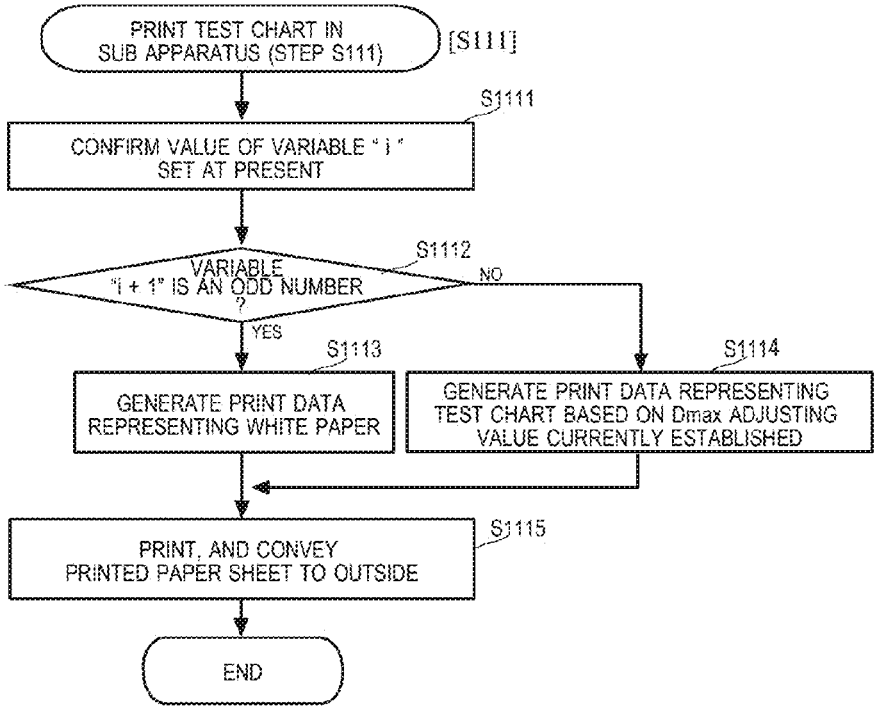
FIG. 8 is a flowchart indicating another subroutine flow of operations to be implemented in an image forming system in accordance with an embodiment of the present invention.

At first, the CPU 151 confirms the current value of variable "i" at present (Step S1101 shown in FIG. 7, Step S1111 shown in FIG. 8). Then, the CPU 151 determines whether variable "i+1", representing the sequence number of the paper sheet that is not outputted but in midcourse of a certain processing at present, is an odd number or an even number (Step S1102 shown in FIG. 7, Step S1112 shown in FIG. 8).

Successively, when determining that variable "i+1" is an odd number (Step S1102; YES, shown in FIG. 7), the CPU 151 makes the first image forming apparatus 100 generate print data representing the test chart based on the Dmax adjusting value established in Step S104 (Step S1103, shown in FIG. 7). Further, the CPU 151 feeds a paper sheet to print the test chart thereon, and then, conveys the printed paper sheet towards the second image forming apparatus 300 (Step S1105, shown in FIG. 7).

As well as the above-mentioned, when determining that variable "i+1" is an odd number (Step S1112; YES, shown in FIG. 8), the CPU 151 makes the second image forming apparatus 300 generate print data representing the white paper (Step S1113, shown in FIG. 8). Further, the CPU 151 receives the paper sheet conveyed from the first image forming apparatus 100, and further conveys the received paper sheet to apply a printing operation based on the print data representing the white paper thereto, and then, conveys and ejects the printed paper sheet towards the external section outside the image forming system concerned (Step S1115, shown in FIG. 8).

Figure 9:
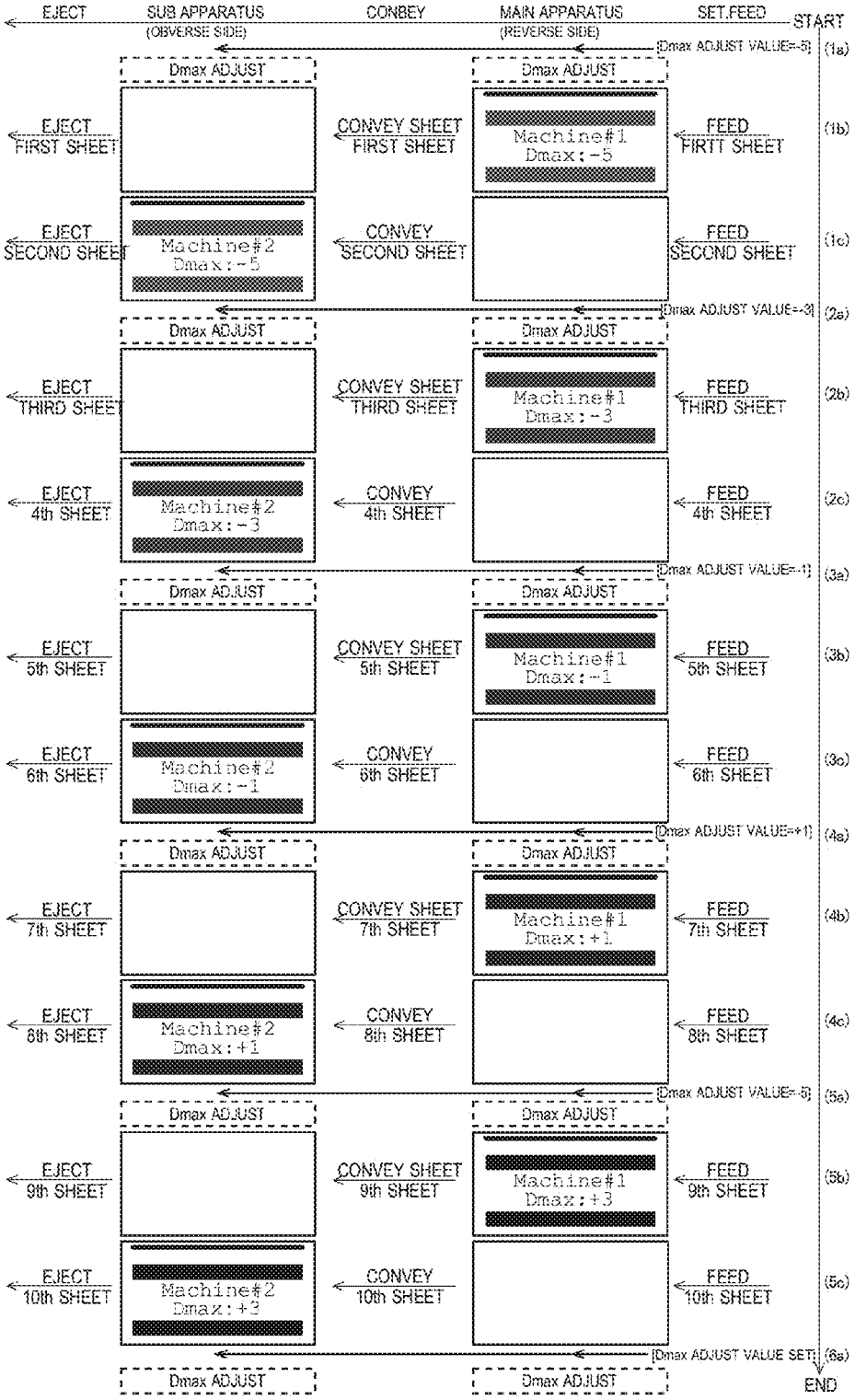
FIG. 9 is a time chart indicating operations for forming test charts, which are to be implemented in an image forming system in accordance with an embodiment of the present invention.

For instance, at the timing when processing the paper sheet of the first order, as shown in FIG. 9, variable "i" is set at the initial value of "0", and variable "i+1"="1", which is the odd number. In this case, after the density adjustment operation based on the Dmax adjusting value=−5 has been completed, the CPU 151 feeds the paper sheet of the first order to make the first image forming apparatus 100 print the test chart onto the reverse side of the paper sheet concerned, and then, makes the second image forming apparatus 300 print white paper onto the obverse side of the same paper sheet, to output the paper sheet concerned.

On the other hand, when determining that variable "i+1" is an even number (Step S1102; NO, shown in FIG. 7), the CPU 151 makes the first image forming apparatus 100 generate print data representing the white paper (Step S1104, shown in FIG. 7). Further, the CPU 151 feeds a paper sheet to apply a printing operation based on the print data representing the white paper thereto, and then, conveys the printed paper sheet towards the second image forming apparatus 300 (Step S1105, shown in FIG. 7).

As well as the above-mentioned, when determining that variable "i+1" is an even number (Step S1112; NO, shown in FIG. 8), the CPU 151 makes the second image forming apparatus 300 generate print data representing the test chart based on the Dmax adjusting value established in Step S104 (Step S1114, shown in FIG. 8). Further, the CPU 151 receives the paper sheet conveyed from the first image forming apparatus 100, and further conveys the received paper sheet to print the test chart based on the print data above-generated, and then, conveys and ejects the printed paper sheet towards the external section outside the image forming system concerned (Step S1115, shown in FIG. 8).

For instance, at the timing when processing the paper sheet of the second order, as shown in FIG. 9, variable "i" is currently set at the value of "1", and variable "i+1"="2", which is the even number. In this case, after the density adjustment operation based on the Dmax adjusting value=−5 has been completed, the CPU 151 feeds the paper sheet of the second order to make the first image forming apparatus 100 print the white paper onto the reverse side of the paper sheet concerned, and then, makes the second image forming apparatus 300 print the test chart onto the obverse side of the same paper sheet, to output the paper sheet concerned.

Now, returning to the flowchart shown in FIG. 4, after the combination of the first image forming apparatus 100 and the second image forming apparatus 300 prints the test chart in the state that variable "i" is set at the initial value of "0" as described in the foregoing (Step S110 and Step S111, shown in FIG. 4), variable "i" is set at "1" (odd number) by implementing the operation of "i=i+1" (Step S112, shown in FIG. 4) (Step S113; ODD NUMBER OTHER THAN SPECIFIED NUMBER, shown in FIG. 4). Then, returning to Step S110, the combination of the first image forming apparatus 100 and the second image forming apparatus 300 again prints the test chart (Step S110 and Step S111, shown in FIG. 4). At this time, variable "i" is changed from "1" to "2" (even number) by implementing the operation of "i=i+1" (Step S112, shown in FIG. 4) (Step S113; EVEN NUMBER OTHER THAN SPECIFIED NUMBER, shown in FIG. 4).

Successively, when variable "i" is equal to "2" (Step S113; EVEN NUMBER OTHER THAN SPECIFIED NUMBER, shown in FIG. 4), the CPU 151 sets the Dmax adjusting value of the image forming section 124 at "Dmax=Dmax_low+(α×i)", and notifies the printer controlling section 124*b* of the revised Dmax adjusting value (Step S114, shown in FIG. 4). As well as the above-mentioned, the CPU 151 sets the Dmax adjusting value of the image forming section 324 at "Dmax=Dmax_low+(α×i)", and notifies the printer controlling section 324*b* of the revised Dmax adjusting value (Step S115, shown in FIG. 4).

In this connection, it is assumed in the present embodiment that the Dmax_low, defined as an adjustable lower limit value of the Dmax adjusting value, is set at "−5", while the Dmax_high, defined as an adjustable upper limit value of the Dmax adjusting value, is set at "+3". Under the above-assumed condition, in a case where 10 sheets of test charts are to be outputted, variable "i" varies stepwise in order of "0", "2", "4", "6", "8", "10", at every time when entering into Step S114. Accordingly, the adjusting value interval coefficient cc is established as α="1". According to the above-mentioned, Dmax="−5" when variable "i"="0" (initial value), Dmax="−3" when variable "i"="2", Dmax="−1" when variable "i"="4", Dmax="+1" when variable "i"="6", Dmax="+3" when variable "i"="8" and Dmax="+5" when variable "i"="10", are established respectively.

In this connection, it is desirable that the specified value of variable "i" and the adjusting value interval coefficient α are derived from the values of Dmax_low and Dmax_high. In other words, in a case where the adjusting range between the Dmax_low and the Dmax_high is relatively wide, it is desirable that the specified value of variable "i" is made to increase, instead of making the adjusting value interval coefficient cc increase, from the density adjustment point of view, which is to be performed by the image forming apparatus in regard to obverse and reverse sides of the paper sheet.

Further, in a case where 18 sheets of test charts are to be outputted by making variable "i" vary stepwise in order of "0", "2", "4", "6", "8", "10", "12", "14", "16", it may be possible to establish the adjusting value interval coefficient cc at "0.5". In this case, it is possible to establish the Dmax adjusting values as Dmax="−5" (initial value) when variable "i"="0" (initial value), Dmax="−4" when variable "i"="2", Dmax="−3" when variable "i"="4", Dmax="−2" when variable "i"="6", Dmax="−1" when variable "i"="8", Dmax="0" when variable "i"="10", Dmax="+1" when variable "i"="12", Dmax="+2" when variable "i"="14" and Dmax="+3" when variable "i"="16", respectively.

Referring to the schematic diagram shown in FIG. 9, the concrete example of the above-mentioned case will be detailed in the following. At first, the Dmax adjusting value is set at "−5" (Line (1*a*), shown in FIG. 9), and then, the first image forming apparatus 100 is made to print out the test chart onto the first paper sheet (Line (1*b*), shown in FIG. 9), while the second image forming apparatus 300 is made to print out the test chart onto the second paper sheet (Line (1*c*) shown in FIG. 9, Step S110 and Step S111 shown in FIG. 4). After that, the Dmax adjusting value is set at "−3" (Step S114 and Step S115, shown in FIG. 4). At this time, the charging voltage (electric potential of the photoreceptor member) and the developing bias voltage, to be employed in the image forming section 124 and the image forming section 324, are adjusted in the state of disabling the operations thereof, so as to achieve the maximum-density target toner adhesion amount corresponding to the Dmax adjusting value currently set at −3 (Line (2*a*) shown in FIG. 9, Step S106 and Step S107, shown in FIG. 4).

Successively, under the condition that the Dmax adjusting value is still set at "−3", the first image forming apparatus 100 is made to print out the test chart onto the third paper sheet (Line (2*b*), shown in FIG. 9), while the second image forming apparatus 300 is made to print out the test chart onto the forth paper sheet (Line (2*c*) shown in FIG. 9, Step S110 and Step S111 shown in FIG. 4). After that, the Dmax adjusting value is set at "−1" (Step S114 and Step S115 shown in FIG. 4). At this time, the charging voltage (electric potential of the photoreceptor member) and the developing bias voltage, to be employed in the image forming section 124 and the image forming section 324, are adjusted in the state of disabling the operations thereof, so as to achieve the maximum-density target toner adhesion amount corresponding to the Dmax adjusting value currently set at −1 (Line (3*a*) shown in FIG. 9, Step S106 and Step S107, shown in FIG. 4).

Still successively, under the condition that the Dmax adjusting value is still set at "−1", the first image forming apparatus 100 is made to print out the test chart onto the fifth paper sheet (Line (3*b*), shown in FIG. 9), while the second image forming apparatus 300 is made to print out the test chart onto the sixth paper sheet (Line (3*c*) shown in FIG. 9, Step S110 and Step S111 shown in FIG. 4). After that, the Dmax adjusting value is set at "+1" (Step S114 and Step S115 shown in FIG. 4). At this time, the charging voltage (electric potential of the photoreceptor member) and the developing bias voltage, to be employed in the image forming section 124 and the image forming section 324, are adjusted in the state of disabling the operations thereof, so as to achieve the maximum-density target toner adhesion amount corresponding to the Dmax adjusting value currently set at +1 (Line (4*a*) shown in FIG. 9, Step S106 and Step S107, shown in FIG. 4).

Still successively, under the condition that the Dmax adjusting value is still set at "+1", the first image forming apparatus 100 is made to print out the test chart onto the seventh paper sheet (Line (4*b*), shown in FIG. 9), while the second image forming apparatus 300 is made to print out the test chart onto the eighth paper sheet (Line (4*c*) shown in FIG. 9, Step S110 and Step S111, shown in FIG. 4). After that, the Dmax adjusting value is set at "+3" (Step S114 and Step S115 shown in FIG. 4). At this time, the charging voltage (electric potential of the photoreceptor member) and the developing bias voltage, to be employed in the image forming section 124 and the image forming section 324, are adjusted in the state of disabling the operations thereof, so as to achieve the maximum-density target toner adhesion amount corresponding to the Dmax adjusting value currently set at +3 (Line (5*a*) shown in FIG. 9, Step S106 and Step S107 shown in FIG. 4).

Yet successively, under the condition that the Dmax adjusting value is still set at "+3", the first image forming apparatus 100 is made to print out the test chart onto the ninth paper sheet (Line (5*b*), shown in FIG. 9), while the second image forming apparatus 300 is made to print out the test chart onto the tenth paper sheet (Line (5*c*) shown in FIG. 9, Step S110 and Step S111 shown in FIG. 4).

At this time, variable "i" has been set at 10 (Step S113; SPECIFIED VALUE, shown in FIG. 4) by implementing the operation of "i=i+1" (Step S112, shown in FIG. 4). Accordingly, through the operation display section 123, the CPU 151 inquires of the user for whether the Dmax adjusting value, repeatedly revised to print out the test charts as above-mentioned, should be returned to the original value before the revisions, or should be changed to any one of the adjusting values employed for outputting the test charts concerned (Step S116, shown in FIG. 4).

In response to the inquiry issued by the CPU 151, the user compares the test charts representing the Dmax adjusting values adjusted in the five stages, which are printed by the first image forming apparatus 100, with the other test charts representing the Dmax adjusting values adjusted in the five stages, which are printed by the second image forming apparatus 300, so as to determine a specific Dmax adjusting value that may achieve a maximum density level desired by the user and coincides between the first image forming apparatus 100 and the second image forming apparatus 300.

In a case where, as a result of reviewing the test charts representing the Dmax adjusting values adjusted in the five stages, the user determines that there is no need to change the process conditions in both first image forming apparatus 100 and the second image forming apparatus 300 (Step S116; NO, shown in FIG. 4), the CPU 151 reads out the original Dmax adjusting value before revised, which has been stored in the RAM 159*b* or the nonvolatile storage 159*c* (Step S102, shown in FIG. 4), therefrom, and notifies the printer controlling section 124*b* and the printer controlling section 324*b* of the original Dmax adjusting value concerned (Step S117 and Step S118, shown in FIG. 4).

Figure 10:
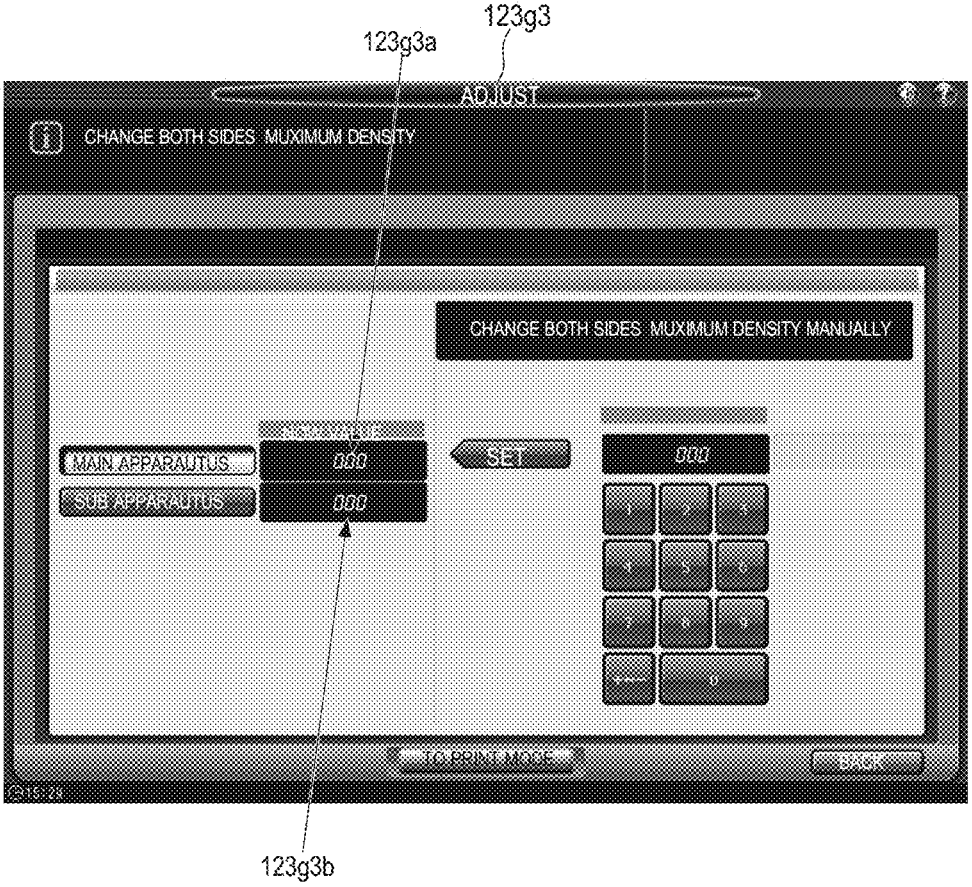
FIG. 10 is a schematic diagram showing an example of another display screen to be displayed in an image forming system in accordance with an embodiment of the present invention.

On the other hand, in a case where, as a result of reviewing the test charts representing the Dmax adjusting values adjusted in the five stages, the user determines that it is necessary to change the process conditions in both first image forming apparatus 100 and the second image forming apparatus 300 so as to make the maximum density levels thereof coincide with each other (Step S116; YES, shown in FIG. 4), the CPU 151 accepts instructed values to which the Dmax adjusting values should be changed, through the operation display section 123 or an external information processing apparatus (Step S119, shown in FIG. 4). For instance, the CPU 151 controls the operation display section 123 to display a display screen 123*g*3 shown in FIG. 10. From the display screen 123*g*3, the CPU 151 accept an instructed value to which the image forming apparatus 100 should change the Dmax adjusting value (area 123*g*3*a* shown in FIG. 10) and also accepts an instructed value to which the second image forming apparatus 300 should change the Dmax adjusting value (area 123*g*3*b* shown in FIG. 10).

Successively, the CPU 151 notifies the printer controlling section 124*b* of the Dmax adjusting value inputted by the user (Step S120, shown in FIG. 4), and also notifies the printer controlling section 324*b* of the Dmax adjusting value inputted by the user (Step S121, shown in FIG. 4).

Still successively, the CPU 151 instructs the printer controlling section 124*b* to implement the maximum density adjustment operation based on either the original Dmax adjusting value before revised or the other Dmax adjusting value inputted by the user (Step S122, shown in FIG. 4). Receiving the adjustment instruction sent from the CPU 151, the printer controlling section 124*b* implements the maximum density adjustment operation, based on the Dmax adjusting value above-established, in the state of disabling the operations to be performed in the first image forming apparatus 100. Concretely speaking, the printer controlling section 124*b* implements the operation for adjusting the charging voltage (electric potential of the photoreceptor member) and the developing bias voltage of the image forming section 124, so as to achieve the target value of toner adhesion amount corresponding to the Dmax adjusting value above-established.

As well as the above-mentioned, the CPU 151 instructs the printer controlling section 324*b* to implement the maximum density adjustment operation based on either the original Dmax adjusting value before revised or the other Dmax adjusting value inputted by the user (Step S122, shown in FIG. 4). Receiving the adjustment instruction sent from the CPU 151, the printer controlling section 324*b* implements the maximum density adjustment operation, based on the Dmax adjusting value above-established, in the state of disabling the operations to be performed in the second image forming apparatus 300. Concretely speaking, the printer controlling section 324*b* implements the operation for adjusting the charging voltage (electric potential of the photoreceptor member) and the developing bias voltage of the image forming section 324, so as to achieve the target value of toner adhesion amount corresponding to the Dmax adjusting value above-established.

Yet successively, the CPU 151 confirms whether or not the maximum density adjustment operation implemented by the printer controlling section 124*b* has been completed (Step S124, shown in FIG. 4), and also confirms whether or not the maximum density adjustment operation implemented by the printer controlling section 324*b* has been completed (Step S125, shown in FIG. 4). When confirming that the maximum density adjustment operations, respectively implemented by the printer controlling section 124*b* and the printer controlling section 324*b*, have been completed, the CPU 151 finalizes the whole processing (END, shown in FIG. 4), and resumes operations for controlling the normal printing operations.

In this connection, in regard to the test chart, which is to be printed onto the first paper sheet by the first image forming apparatus 100, and the other test chart, which is to be printed onto the second paper sheet by the second image forming apparatus 300, it is desirable that the name (or ID) of the image forming apparatus and the Dmax adjusting value are clearly indicated within a test-chart printed area, in order to clarify from which image forming apparatus the concerned test chart has been printed out and what value has been employed as the Dmax adjusting value for printing the test chart concerned. By clearly indicating as above-mentioned, it becomes possible for the user to easily establish the maximum density desired by the user. According to the example shown in FIG. 9, associating with the density patch of the test chart, the name of the image forming apparatus and the Dmax adjusting value are displayed as "Machine #1", "Dmax=−5" and so on. The above-displayed indications represent that the first image forming apparatus 100, serving as the main apparatus, is adjusted on the basis of "Dmax=−5".

<Second Operation>

Next, referring to the flowchart shown in FIG. 11, an operation for making the halftone density level of the first image forming apparatus 100 and that of the second image forming apparatus 300 coincide with each other, will be detailed in the following as the second operation of the present embodiment.

Figure 11:
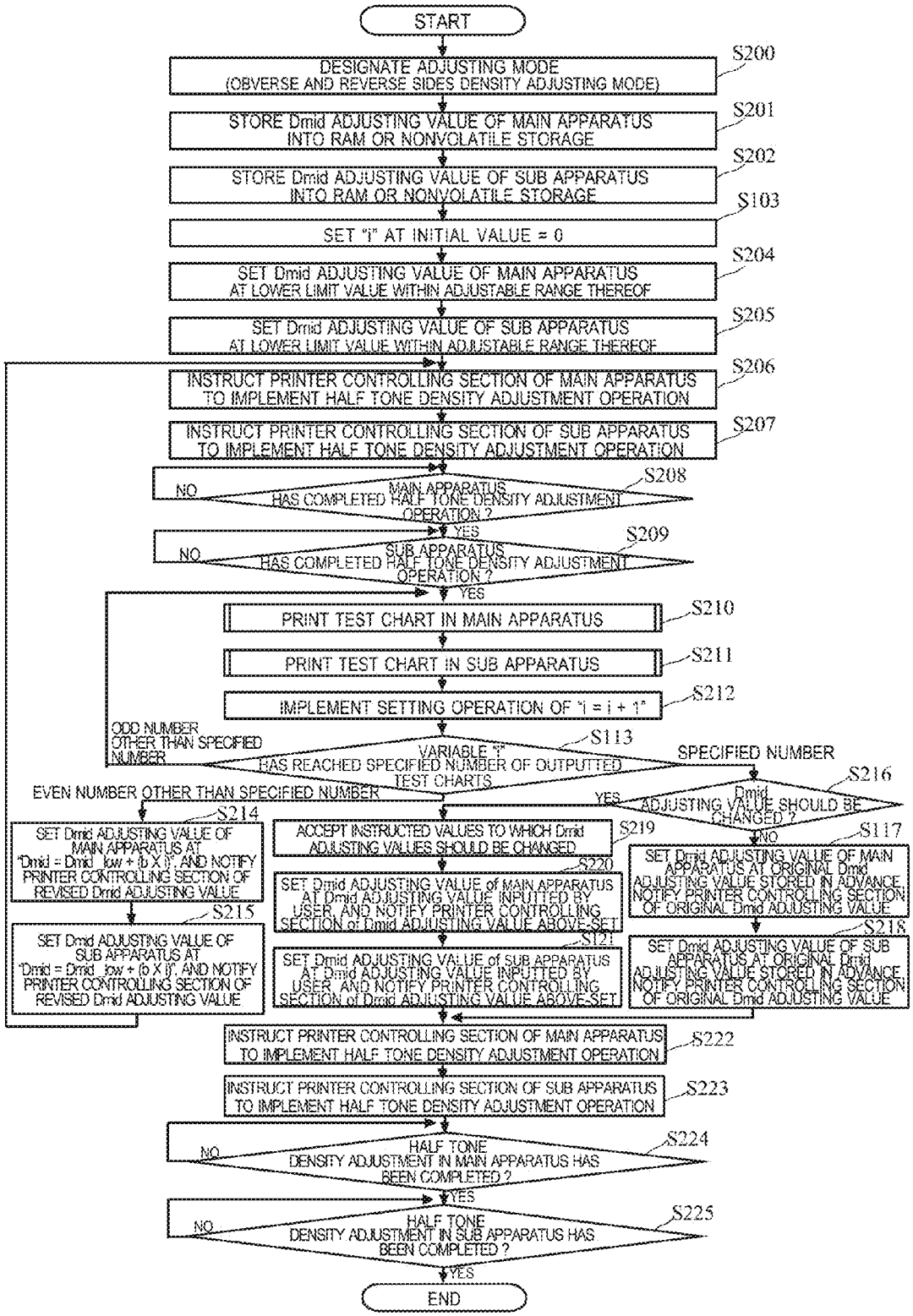
FIG. 11 is a flowchart indicating a flow of operations to be implemented in an image forming system in accordance with an embodiment of the present invention.

Herein, corresponding to the flowchart of the maximum density adjustment operation shown in FIG. 4, FIG. 11 shows a flowchart indicating a flow of implementing the halftone density adjustment operation. Further, corresponding to the flowcharts indicating flows for implementing the test chart printing operations in the maximum density adjustment operation shown in FIG. 7 and FIG. 8, the flowcharts shown in FIG. 12 and FIG. 13 indicate flows for implementing the test chart printing operations in the halftone density adjustment operation.

Figure 14:
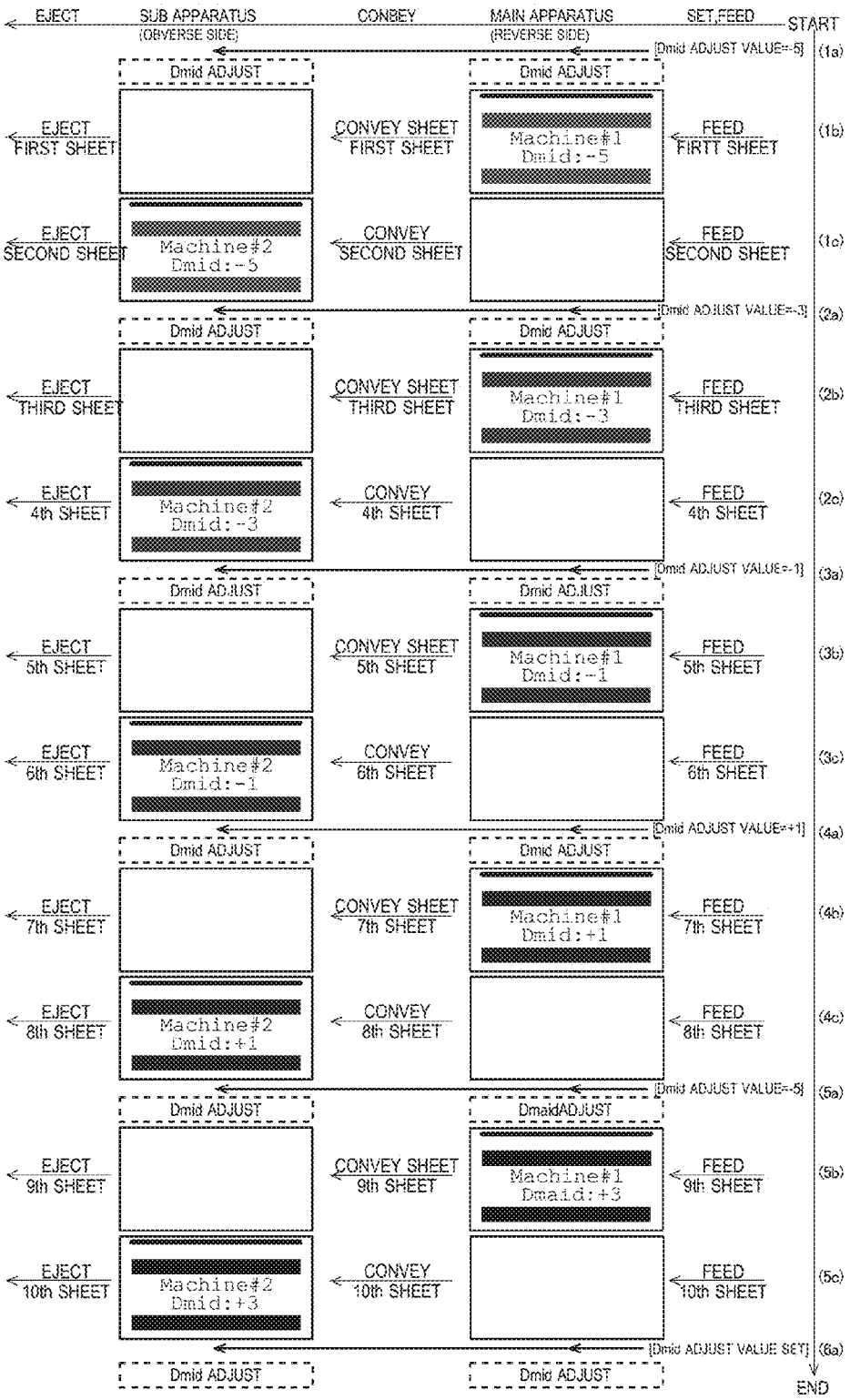
FIG. 14 is a time chart indicating operations for forming test charts, which are to be implemented in an image forming system in accordance with an embodiment of the present invention.

Further, corresponding to the time chart shown in FIG. 9, indicating output statuses of the test charts in the maximum density adjustment operation, FIG. 14 is a time chart indicating output statuses of the test charts in the halftone density adjustment operation.

Figure 12:
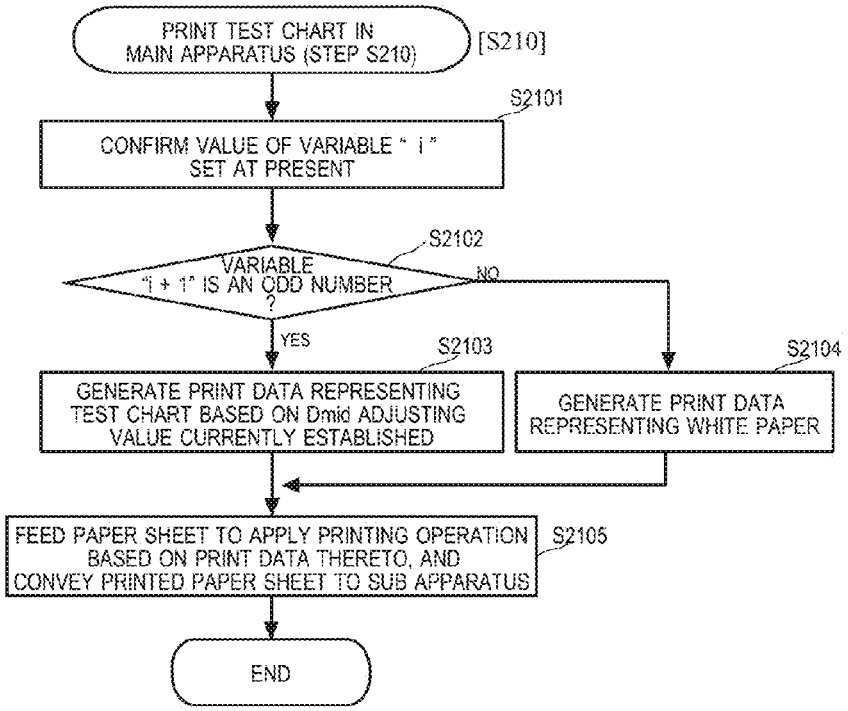
FIG. 12 is a flowchart indicating a subroutine flow of operations to be implemented in an image forming system in accordance with an embodiment of the present invention.
Figure 13:
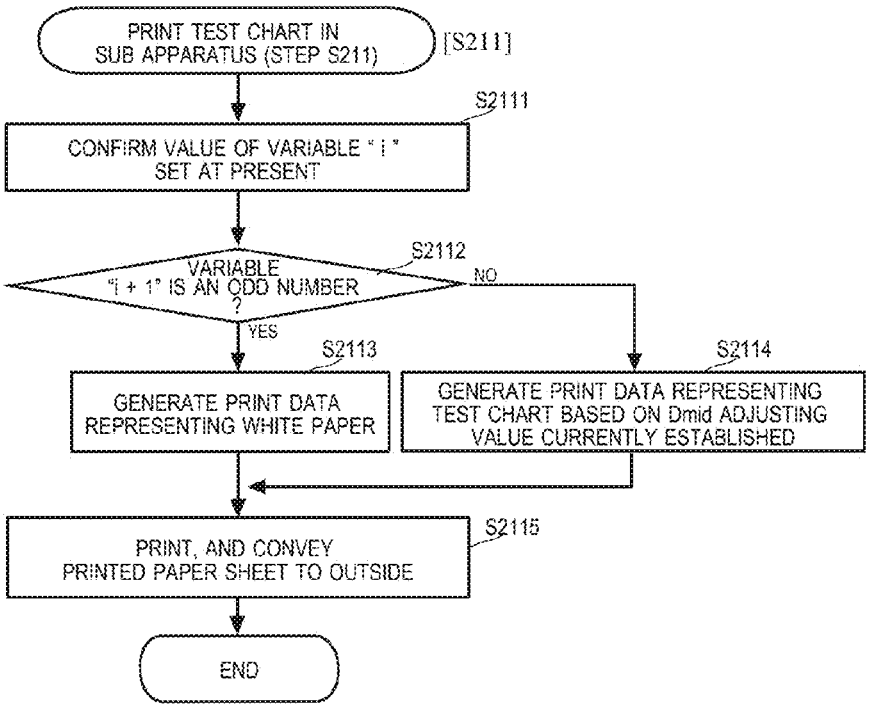
FIG. 13 is a flowchart indicating another subroutine flow of operations to be implemented in an image forming system in accordance with an embodiment of the present invention.

In this connection, the step numbers of Steps S200 through S225, Steps S2101 through S2105 and Steps S2111 through S2115, respectively attached to the operations included in the flowcharts shown in FIG. 11, FIG. 12 and FIG. 13 are made to respectively correspond to the step numbers of Steps S110 through S125, Steps S1101 through S1105 and Steps S1111 through S1115, respectively attached to the operations included in the flowcharts shown in FIG. 4, FIG. 7 and FIG. 8, as the same or similar operations as each other. In other words, for instance, Step S2XY shown in FIG. 11 corresponds to Step SIXTY shown in FIG. 4, and so on. Accordingly, duplicated and detailed explanations in regard to each of the steps will be omitted in the following.

Figure 5:
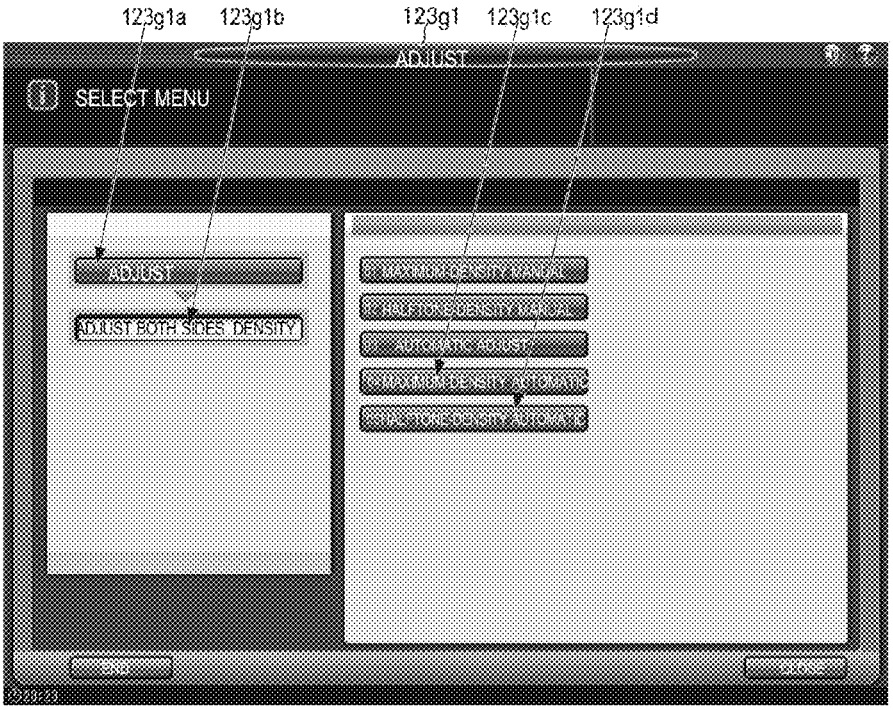
FIG. 5 is a schematic diagram showing an example of a display screen to be displayed in an image forming system in accordance with an embodiment of the present invention.

In a case where the both-sides density adjusting mode is to be instructed from the operation display section 123 as the second operation of the present embodiment, the user designates the adjustment mode from the display screen 123*g*1 by depressing the button 123*g*1*a* shown in FIG. 5, and then, designates the both-sides density adjusting mode by depressing the button 123*g*1*b* shown in FIG. 5, and further, selects a both-sides halftone-density automatic adjusting mode by depressing a button 123*g*1*d* shown in FIG. 5. After that, according to the procedures being similar to those of the maximum density adjustment operation based on the Dmax adjusting value in the first operation of the present embodiment, the CPU 151 implements the halftone density adjustment operation based on a Dmid adjusting value in the second operation concerned.

As well as in the first operation, in the second operation of the present embodiment, the initial value of the Dmid adjusting value is established at Dmid_low serving as a lower limit value of the Dmid adjusting value, while, corresponding to variable "i" of the output number of test charts and adjusting value interval coefficient β, the Dmid adjusting value is established by employing the Equation "Dmid=Dmid_low+(β×i)". In this connection, it is desirable that the specified value of variable "i" and adjusting value interval coefficient β are derived from Dmid_low and Dmid_high.

Further, as indicated in the time chart shown in FIG. 14 corresponding to that shown in FIG. 9, it becomes possible to sequentially output test charts one by one while changing the Dmid adjusting value. Still further, as the halftone density adjustment operation above-mentioned, it is applicable not only to apply a density adjustment processing to a certain specific density in the vicinity of the middle density level based on the Dmid adjusting value, but also to implement another density adjustment processing in which an adjustment processing based on the Dmid adjusting value and another adjustment processing based on the Dmax adjusting value are combined with each other.

According to the embodiments in accordance with the present invention, which have been described in the foregoing, the following effects can be attained.

(1) In the tandem-method image forming system that includes a plurality of image forming apparatuses that forms images onto a recording paper sheet and a network through which the plurality of image forming apparatuses is serially cascaded so as to make it possible to share operations for forming the images onto different areas of the recording paper sheet between the plurality of image forming apparatuses, corresponding to the target density, each of the plurality of image forming apparatuses, which are operated in conjunction with each other through the network, revises the process condition for a plural number of times within an adjustable range, and outputs the test chart at every time when the process condition is revised. Accordingly, since the user can select the target density of each of the plurality of image forming apparatuses by referring to the test chart outputted thereby, it becomes possible for the user to effectively adjust the density level of each of the plurality of image forming apparatuses serially cascaded.

(2) In the tandem-method image forming system recited in item 1, when the process condition is adjusted so as to make densities of images, which are to be respectively formed by the plurality of image forming apparatuses, coincide with each other therebetween, each of the plurality of image forming apparatuses, which are operated in conjunction with each other through the network, revises the process condition for the plural number of times, and outputs the test chart. Accordingly, by referring to the test charts outputted thereby, it becomes possible for the user to select the target density, which is to be employed at the time when the densities of the plurality of the image forming apparatuses are made to coincide with each other. As a result, it becomes possible for the user to effectively adjust the density level of each of the plurality of image forming apparatuses serially cascaded.

(3) In the tandem-method image forming system recited in item 1 or 2, when the process condition is adjusted so as to make maximum densities of images, which are to be respectively formed by the plurality of image forming apparatuses, coincide with each other therebetween, each of the plurality of image forming apparatuses, which are operated in conjunction with each other through the network, revises the process condition for the plural number of times, and outputs the test chart. Accordingly, by referring to the test charts outputted thereby, it becomes possible for the user to select the target density, which is to be employed at the time when the maximum densities of the plurality of the image forming apparatuses are made to coincide with each other. As a result, it becomes possible for the user to effectively adjust the density level of each of the plurality of image forming apparatuses serially cascaded.

(4) In the tandem-method image forming system recited in any one of items 1-3, when the process condition is adjusted so as to make halftone densities of images, which are to be respectively formed by the plurality of image forming apparatuses, coincide with each other therebetween, each of the plurality of image forming apparatuses, which are operated in conjunction with each other through the network, revises the process condition for the plural number of times, and outputs the test chart. Accordingly, by referring to the test charts outputted thereby, it becomes possible for the user to select the target density, which is to be employed at the time when the halftone densities of the plurality of the image forming apparatuses are made to coincide with each other. As a result, it becomes possible for the user to effectively adjust the density level of each of the plurality of image forming apparatuses serially cascaded.

(5) In the tandem-method image forming system recited in any one of items 1-4, every time when revising the process condition for the plural number of times, each of the plurality of image forming apparatuses outputs the test chart. The above-outputted test chart includes information representing an adjusting value to be employed at the time when the process condition is revised and other information indicating one of the plurality of image forming apparatuses, from which the test chart is printed out. Accordingly, since the user can select the target density of each of the plurality of image forming apparatuses by referring to the test chart outputted thereby, it becomes possible for the user to effectively adjust the density level of each of the plurality of image forming apparatuses serially cascaded.

(6) In the tandem-method image forming system recited in any one of items 1-5, each of the plurality of image forming apparatuses stores still other information representing the process condition before revised, therein. After operations for revising the process condition and outputting the test chart have been completed, each of the plurality of image forming apparatuses resumes the process condition before revised. Accordingly, even in a case where the density of each of the plurality of image forming apparatuses is not adjusted after the process condition has been revised for the plural number of times therein, it becomes possible to make each of the plurality of image forming apparatuses resume the original state.

(7) In the tandem-method image forming system recited in any one of items 1-5, after operations for revising the process condition and outputting the test chart have been completed, each of the plurality of image forming apparatuses adjusts the process condition based on the adjusting value accepted. Accordingly, it becomes possible for the user to effectively adjust the density level of each of the plurality of image forming apparatuses serially cascaded.

Other Embodiments

Referring to the drawings, the present embodiment has been described in the foregoing. However, the scope of the present invention is not limited to the embodiment described in the foregoing. Various kinds of modifications and additions made by a skilled person without departing from the spirit and scope of the invention shall be included in the scope of the present invention.

Although, in the embodiment described in the foregoing, the operations for outputting the test charts associating with the density adjustment operations are implemented under the controlling operations conducted by the CPU 151, the scope of the present invention is not limited to the embodiment aforementioned. For instance, the CPU 351, which is incorporated in the second image forming apparatus 300 side, may conduct the controlling operations above-mentioned. Further, the image forming system may be so constituted that a certain computer or the like, which is coupled to the image forming system so as to make it possible to electrically communicate with each other through a network, controls the operations for outputting the test charts associating with the density adjustment operations to be performed in the image forming system concerned.

Further, although, in the embodiment described in the foregoing, the charging voltage (electric potential of the photoreceptor member) and the developing bias voltage are adjusted on the basis of the Dmax adjusting value and/or the Dmid adjusting value, the scope of the present invention is not limited to the above-mentioned. Any one of various kinds of voltages, electric currents, etc., in each of the sections provided in the image forming system, may be employed as an adjusting value for the above-mentioned purpose.

Still further, although the Dmax adjusting value is established by employing the Equation of "Dmax=Dmax_low+(axi)" in the first operation aforementioned, while the Dmid adjusting value is established by employing the Equation of "Dmid=Dmid_low+(β×i)" in the second operation aforementioned, the scope of the present invention is not limited to the above-mentioned. For instance, instead of setting the adjusting value interval coefficient cc and/or the adjusting value interval coefficient β at a value representing equal intervals, it is possible to set it at values representing irregular pitched intervals including a finely divided portion in the vicinity of "0" and coarsely divided portion in the vicinity of either the "upper limit value" or the "lower limit value". Alternatively, in such a case that, as a result of setting the adjusting value interval coefficient cc and/or the adjusting value interval coefficient β at a value representing equal intervals, the test chart at "Dmax adjusting value=0" does not exist, it is possible to include "Dmax adjusting value=0" thereinto. According to the above-mentioned, for instance, in the first operation, it is possible to change the queue of the Dmax adjusting values −5, −3, −1, +1, +3 to another queue of Dmax adjusting values −5, −3, −1, 0, +1, +3.

Still further, in the embodiment described in the foregoing, the printer controlling section 110 is incorporated into the first image forming apparatus 100, while the printer controlling section 310 is incorporated into the second image forming apparatus 300. However, the scope of the present invention is not limited to the embodiment aforementioned. For instance, it is also possible to dispose the printer controllers at external sections outside the first image forming apparatus 100 and the second image forming apparatus 300.

Still further, each of the first image forming apparatus 100 and the second image forming apparatus 300 in the present embodiment may be configured as a standalone printer without being provided with the scanner section 122 or the scanner section 322 and so on. In addition, it is needless to say that each of the first image forming apparatus 100 and the second image forming apparatus 300 may be either a monochrome image forming apparatus or a color image forming apparatus.

Still further, each of the paper sheet feeding apparatus 50, the intermediate processing apparatus 200 and the post processing apparatus 400 may be operated as needed, and it is also possible to make the first image forming apparatus 100 or the second image forming apparatus 300 incorporate any one of them therein.

Yet further, not only in the case of the combination of two image forming apparatuses including the first image forming apparatus 100 and the second image forming apparatus 300, but also in such a case that three or more image forming apparatuses are cascaded, it becomes possible to implement the density adjustment by applying the embodiment in accordance with the present invention thereto.

While the preferred embodiments of the present invention have been described using specific term, such description is for illustrative purpose only, and it is to be understood that changes and variations may be made without departing from the spirit and scope of the appended claims.

What is claimed is:

1. An image forming system, comprising:

a plurality of image forming apparatuses that forms images onto a recording paper sheet; and a network through which the plurality of image forming apparatuses is serially cascaded so as to make it possible to share operations for forming the images onto different areas of the recording paper sheet between the plurality of image forming apparatuses;

wherein each of the plurality of image forming apparatuses comprises:

an image forming section that forms an image onto a paper sheet; and a control section that is provided with a process condition adjusting function for adjusting a process condition to be employed at a time when forming the image onto the paper sheet corresponding to a target density currently established, and a test-chart outputting function for outputting a test chart under the process condition above-adjusted; and wherein, corresponding to the target density, each of the plurality of image forming apparatuses, which are operated in conjunction with each other through the network, revises the process condition for a plural number of times within an adjustable range, and outputs the test chart at every time when the process condition is revised.

2. The image forming system of claim 1, wherein, when the process condition is adjusted so as to make densities of images, which are to be respectively formed by the plurality of image forming apparatuses, coincide with each other therebetween, each of the plurality of image forming apparatuses, which are operated in conjunction with each other through the network, revises the process condition for the plural number of times, and outputs the test chart.

3. The image forming system of claim 1, wherein the process condition is adjusted in order to establish a maximum density.

4. The image forming system of claim 1, wherein the process condition is adjusted in order to establish a halftone density.

5. The image forming system of claim 1, wherein the test chart includes first information representing an adjusting value, which is employed at the time when the process condition is revised within the adjustable range and second information indicating one of the plurality of image forming apparatuses, from which the test chart is printed out.

6. The image forming system of claim 1, wherein each of the plurality of image forming apparatuses stores third information representing the process condition before revised, therein; and wherein, after operations for revising the process condition within the adjustable range and outputting the test chart have been completed, each of the plurality of image forming apparatuses resumes the process condition before revised.

7. The image forming system of claim 1, wherein each of the plurality of image forming apparatuses is provided with a function for accepting an adjusting value, which is to be employed at the time when the process condition is revised; and wherein, after operations for revising the process condition within the adjustable range and outputting the test chart have been completed, each of the plurality of image forming apparatuses adjusts the process condition based on the adjusting value above-accepted.

8. A method for controlling an image forming operation, which is to be implemented in an image forming system that comprises a plurality of image forming apparatuses that forms images onto a recording paper sheet, and a network through which the plurality of image forming apparatuses is serially cascaded so as to make it possible to share operations for forming the images onto different areas of the recording paper sheet between the plurality of image forming apparatuses, wherein each of the plurality of image forming apparatuses is constituted by an image forming section that forms an image onto a paper sheet; and a control section that is provided with a process condition adjusting function for adjusting a process condition to be employed at a time when forming the image onto the paper sheet corresponding to a target density currently established, and a test-chart outputting function for outputting a test chart under the process condition above-adjusted, the method comprising the steps of:

operating the plurality of image forming apparatuses in conjunction with each other through the network;

making each of the plurality of image forming apparatuses revise the process condition, corresponding to the target density, for a plural number of times within an adjustable range; and outputting the test chart at every time when the process condition is revised.

9. The method of claim 8, wherein, when the process condition is adjusted so as to make densities of images, which are to be respectively formed by the plurality of image forming apparatuses, coincide with each other therebetween, each of the plurality of image forming apparatuses, which are operated in conjunction with each other through the network, revises the process condition for the plural number of times, and outputs the test chart.

10. The method of claim 8, wherein the process condition is adjusted in order to establish a maximum density.

11. The method of claim 8, wherein the process condition is adjusted in order to establish a halftone density.

12. The method of claim 8, further comprising the step of:

creating the test chart so that the test chart includes first information representing an adjusting value, which is employed at the time when the process condition is revised within the adjustable range and second information indicating one of the plurality of image forming apparatuses, from which the test chart is printed out.

13. The method of claim 8, wherein each of the plurality of image forming apparatuses stores third information representing the process condition before revised, therein; and wherein, after operations for revising the process condition within the adjustable range and outputting the test chart, have been completed, each of the plurality of image forming apparatuses resumes the process condition before revised.

14. The method of claim 8, wherein each of the plurality of image forming apparatuses is provided with a function for accepting an adjusting value, which is to be employed at the time when the process condition is revised; and wherein, after operations for revising the process condition within the adjustable range and outputting the test chart have been completed, each of the plurality of image forming apparatuses adjusts the process condition based on the adjusting value above-accepted.

* * * * *